US005802789A

United States Patent [19]

Goodman et al.

[11] Patent Number: 5,802,789

[45] Date of Patent: Sep. 8, 1998

[54] PARTITION CONSTRUCTION INCLUDING REMOVABLE COVER PANELS

[75] Inventors: Steven F. Goodman; Kenneth D. Brickner, both of Wyoming; Melissa A. DuBuis, Jenison; Daniel Grabowski; Allen C. Hager, both of Grand Rapids; Robert E. Jeffers, Ada; Karl J. Mead, Grand Rapids; Scott M. Miller, Kentwood; Kurt A. Jonker, Grand Rapids, all of Mich.

[73] Assignee: Steelcase, Inc., Grand Rapids, Mich.

[21] Appl. No.: 767,817

[22] Filed: Dec. 17, 1996

[51] Int. Cl.[6] ..... E04M 3/00

[52] U.S. Cl. ..... 52/239; 52/238.1; 52/36.1; 160/357

[58] Field of Search ..... 52/239, 238.1, 52/243, 36.1, 36.6, 656.1, 656.2, 656.9, 271, 592.6, 486, 489, 487, 478, 397, 726, 242, 241; 403/231, 230, 375; 160/135, 351

[56] References Cited

U.S. PATENT DOCUMENTS

| | | | |
|---|---|---|---|
| 1,355,756 | 10/1920 | Earley . | |
| 1,389,057 | 8/1921 | Lavigue . | |
| 1,890,954 | 12/1932 | Snyder . | |
| 2,121,213 | 6/1938 | Small | 189/85 |
| 2,281,519 | 4/1942 | Faber | 72/118 |
| 2,416,240 | 2/1947 | Strandlund | 189/86 |
| 2,637,423 | 5/1953 | Creegan | 189/78 |
| 2,914,936 | 12/1959 | Reinold | 72/18 |
| 3,340,654 | 9/1967 | Maier, Jr. | 52/97 |

(List continued on next page.)

OTHER PUBLICATIONS

Steelcase Series 9000™ Wiring/Cabling Catalog (12 pages), 1995.

*Primary Examiner*—Creighton Smith
*Attorney, Agent, or Firm*—Price, Heneveld, Cooper, DeWitt & Litton

[57] ABSTRACT

A partition panel includes a partition frame with a planar face having clip-receiving apertures for supporting cover panels and bracket-receiving apertures for supporting furniture components. A pair of cover panels configured to cover the partition frame include side edges that define a gap therebetween for providing access to the bracket-receiving apertures when the cover panels are attached to the partition frame. Clips on the cover panels are constructed to releasably engage the clip-receiving apertures for retaining the cover panels on the partition frame in a coplanar arrangement. The clips each include an antidislodgement tooth for interlockingly engaging a back surface of the face when the clips are engaged with the clip-receiving apertures, and further include a release tab that is depressible to move the tooth to a disengaged position for releasing the clip from the associated clip-receiving aperture. The clips are located at a position spaced away from the gap and behind the cover panels so that the clips are not visible through the gap from a position in front of the cover panels. A flexible strip is attached to one of the cover panels for covering the gap when the cover panels are attached to the partition frame in a coplanar and adjacent position thereon.

20 Claims, 19 Drawing Sheets

U.S. PATENT DOCUMENTS

| | | | |
|---|---|---|---|
| 3,408,127 | 10/1968 | Vincens | 312/194 |
| 3,478,997 | 11/1969 | Goss | 248/488 |
| 3,571,987 | 3/1971 | Anderson | 52/27 |
| 3,690,083 | 9/1972 | Miller | 52/481 |
| 3,694,981 | 10/1972 | Cremer et al. | 52/235 |
| 3,696,575 | 10/1972 | Armstrong | 52/287 |
| 3,700,385 | 10/1972 | Sherwood | 52/36 |
| 3,802,146 | 4/1974 | Tacke et al. | 52/624 |
| 3,941,180 | 3/1976 | Thill | 160/229 R |
| 3,990,204 | 11/1976 | Haworth et al. | 52/239 |
| 3,998,018 | 12/1976 | Hodges | 52/481 |
| 4,257,203 | 3/1981 | Propst et al.. | 52/221 |
| 4,307,551 | 12/1981 | Crandell | 52/235 |
| 4,356,674 | 11/1982 | Propst et al. | 52/242 |
| 4,423,573 | 1/1984 | Omholt et al. | 52/145 |
| 4,520,607 | 6/1985 | Suckow | 52/489 |
| 4,546,582 | 10/1985 | Gartner | 52/235 |
| 4,563,849 | 1/1986 | Mangal | 52/235 |
| 4,599,838 | 7/1986 | Kaminaga | 52/235 |
| 4,660,339 | 4/1987 | Paz | 52/238.1 |
| 4,731,960 | 3/1988 | Sease | 52/36 |
| 4,765,107 | 8/1988 | Ting | 52/235 |
| 4,873,806 | 10/1989 | Jeschke | 52/235 |
| 4,882,885 | 11/1989 | Chatterson et al. | 52/221 |
| 4,918,886 | 4/1990 | Benoit et al. | 52/221 |
| 4,995,215 | 2/1991 | Menchetti | 52/747 |
| 5,062,246 | 11/1991 | Sykes | 52/126.4 |
| 5,086,597 | 2/1992 | Kelley et al. | 52/239 |
| 5,175,969 | 1/1993 | Knauf et al. | 52/239 |
| 5,239,798 | 8/1993 | Saito | 52/235 |
| 5,355,645 | 10/1994 | Farag | 52/235 |
| 5,377,461 | 1/1995 | DeGrada et al. | 52/126.4 |
| 5,379,561 | 1/1995 | Saito | 52/235 |
| 5,394,658 | 3/1995 | Schreiner et al. | 52/36.1 |
| 5,400,560 | 3/1995 | Hellwig et al. | 52/578 |
| 5,406,760 | 4/1995 | Edwards | 52/239 |
| 5,408,796 | 4/1995 | Hashimoto et al. | 52/489.2 |
| 5,481,839 | 1/1996 | Lang et al. | 52/235 |
| B1 4,876,835 | 6/1992 | Kelly et al. | 52/239 |

PARTITION CONSTRUCTION INCLUDING REMOVABLE COVER PANELS

REFERENCE TO RELATED APPLICATION

The present application is related to the coassigned, copending U.S. patent application Ser. No. 08/767,814 filed Dec. 17, 1996 entitled PARTITION CONSTRUCTION.

BACKGROUND OF THE INVENTION

The present invention concerns a freestanding partition panel having a frame adapted to support furniture components at off-module locations, and including releasably attached cover panels constructed for aesthetics while also being constructed to permit access to the off-module locations.

Modern office arrangements emphasize aesthetics as well as functionality. This creates a conflict because functionality requires the ability to make connections and attachments, such as by use of holes and flanges, while aesthetics necessitates clean lines and optimal appearance, such as an absence of holes and flanges. This conflict is most apparent where a plurality of discrete off-module attachment locations, such as holes and slots are provided. The term "off module" is used herein to mean attachment of a first partition panel to a second partition panel with a vertical side edge of the first panel abutting a side face of the second partition panel at a location between the vertical side edges of the second partition panel. A partition panel system is desired where the partition panels of the system provide a clean and attractive appearance, but where the partition panels include a high degree of connectability and functionality for supporting furniture components in off-module locations.

Modern offices further require that the partition panels be adapted to carry utilities, such as electrical power and communication cabling. Further, the partition panels must permit reconfiguration and adaptation to meet changing office environments and requirements. One alternative is to provide partition frames that are internally open, and to provide removably attachable cover panels therefor. However, removable cover panels can be problematic since the cover panels may inadvertently come loose or otherwise not be properly engaged unless adequate care is taken. This can also result in cover panels being loose, such that corners of the cover panels protrude outwardly to a non-flush, non-coplanar condition relative to other cover panels on the partition frame. Still further, the frame engaging clips of the cover panels can loose their strength or become deformed/damaged. Still another problem is where municipal codes and/or states require that cover panels be retained on partition frames with a required positive connection to resist catastrophic failure, such as earthquakes. Thus, a partition system is required having a connection system that is strong enough to resist failure from catastrophic events, but that is releasable to permit access to internal utilities.

Accordingly, a partition panel system solving the aforementioned problems is desired.

SUMMARY OF THE INVENTION

In one aspect, the present invention includes a partition panel having a partition frame with a planar face with clip-receiving apertures for supporting cover panels and bracket-receiving apertures for supporting furniture components. A pair of cover panels configured to cover the partition frame include side edges that define a gap therebetween for providing access to the bracket-receiving apertures when the cover panels are attached to the partition frame. Clips on the cover panels are constructed to releasably engage the clip-receiving apertures for retaining the cover panels on the partition frame in a coplanar arrangement. The clips each include an antidislodgement tooth for interlockingly engaging a back surface of the frame face when the clips are engaged with the clip-receiving apertures, and further include a release tab that is depressible to move the tooth to a disengaged position for releasing the clips from the clip-receiving apertures. A flexible strip is attached to one of the cover panels for covering the gap when the cover panels are attached to the partition frame in a coplanar and adjacent position thereon.

In another aspect, a partition panel includes a partition frame having a planar face with bracket-receiving apertures for supporting furniture components, and a pair of cover panels attached to the partition frame. The cover panels include side edges that define a gap therebetween for providing access to the bracket-receiving apertures. A flexible strip is attached to one of the cover panels for covering the gap and the bracket-receiving apertures. A bracket includes a connector portion shaped to depress the flexible strip and to engage selected ones of the bracket-receiving apertures to support furniture components on the partition frame.

In another aspect, a partition panel includes a partition frame having a planar face with clip-receiving apertures for supporting cover panels and bracket-receiving apertures for supporting furniture components. A pair of cover panels are configured to cover the partition frame, the cover panels including side edges that define a gap therebetween for providing access to the bracket-receiving apertures when the cover panels are attached to the partition frame. The cover panels include clips constructed to releasably engage the clip-receiving apertures for retaining the cover panels on the partition frame in a coplanar arrangement. The clips each include an antidislodgement tooth for interlockingly engaging a back surface of the face when the clips are engaged with the clip-receiving apertures, and further include a release tab that is depressible to move the tooth to a disengaged position for releasing the clips from the clip-receiving apertures. The clips are located at a position spaced away from the gap and behind the cover panels so that the clips are not visible through the gap from a position in front of the cover panels.

In another aspect, a method includes steps of providing a partition frame having a planar face with clip-receiving apertures for supporting cover panels and bracket-receiving apertures for supporting furniture components, the planar face having a back surface. The method further includes providing a pair of cover panels releasably attached to the partition frame for covering the partition frame, the cover panels including side edges that define a gap therebetween for providing access to the bracket-receiving apertures when the cover panels are attached to the partition frame. The cover panels each include clips constructed to releasably engage the clip-receiving apertures for retaining the cover panels on the partition frame in a coplanar arrangement, the clips each including a tooth for interlockingly engaging the back surface when the clips are engaged with the clip-receiving apertures, and further including a release tab that is depressible to move the tooth to a disengaged position for releasing the clips from the clip-receiving apertures. The clips are located at a position spaced away from the gap and behind the cover panels so that the clips are not visible through the gap from a position in front of the cover panels. A tool is provided that is adapted to extend through the gap and extend behind a selected cover panel to engage a release tab on a selected clip. The method includes depressing a particular one of the release tabs to release the associated tooth from engagement with the back surface of the partition frame, sliding the tool along the gap to a next one of the clips, and repeating the steps of depressing and sliding until the clips of the cover panel are disengaged from the partition frame.

These and other features and advantages of the present invention will be further understood and appreciated by those skilled in the art by reference to the following specification, claims, and appended drawings.

DETAILED DESCRIPTION OF PREFERRED EMBODIMENT

For purposes of description herein, the terms "upper," "lower," "right," "left," "rear," "front," "vertical," "horizontal," and derivatives thereof shall relate to the invention as oriented with the front of the partition frame being located adjacent a worker standing in front of the partition frame. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 15:
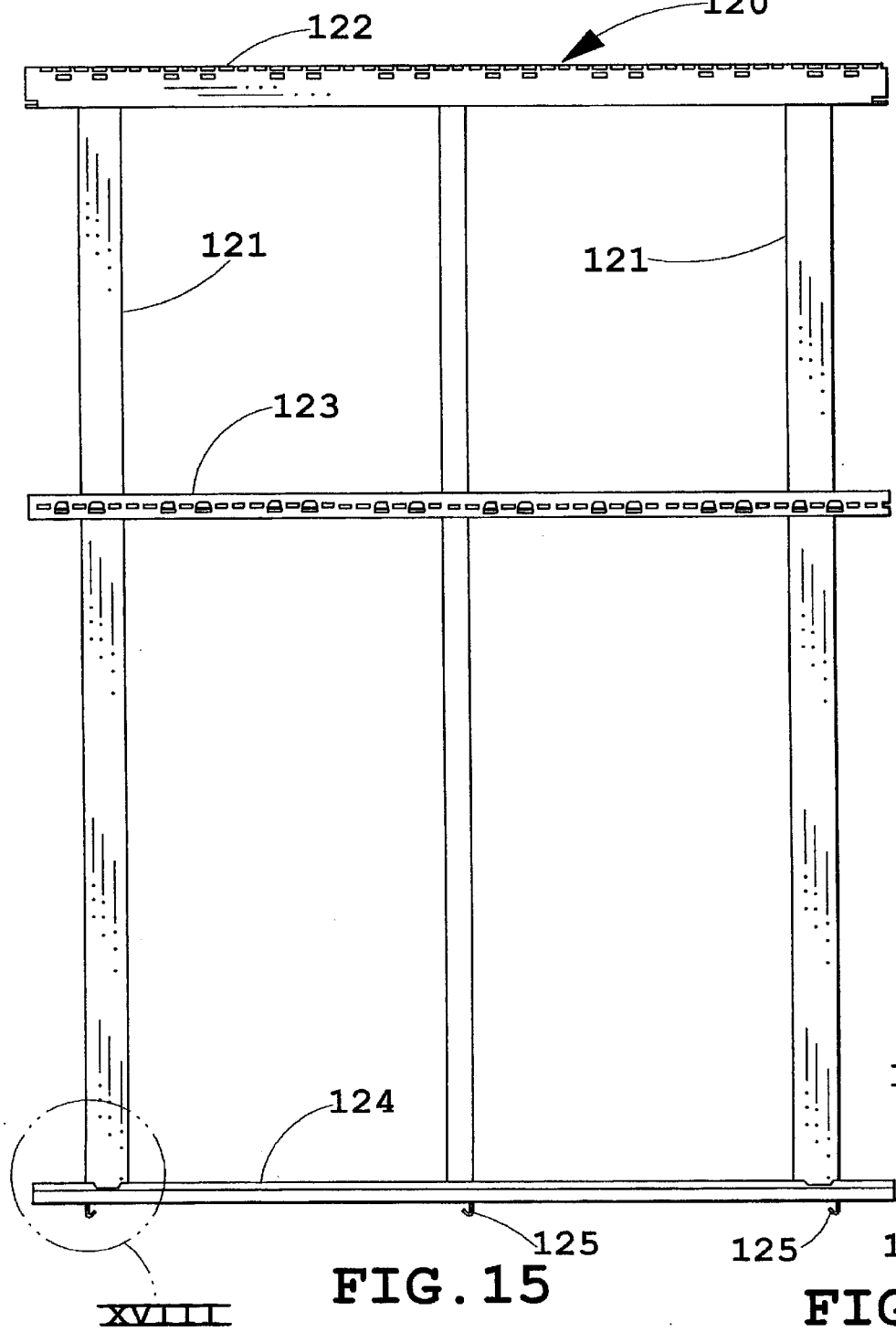

A furniture system 40 (FIG. 1) embodying the present invention includes a plurality of interconnectable systems, such as the systems described in the above-identified applications. The furniture system 40 further includes a freestanding partition panel system 41 comprising four-inch wide partition panels 42 (herein called four-inch "ZONEWALL" partition panels) and two-inch wide partition panels 43 (herein called two-inch "ZONEWALL" or "FINWALL" partition panels). The partition panels 42 and 43 include a plurality of different height and width, preassembled frames, such as the illustrated base partition frames 44 (FIG. 2) and 45 (FIG. 22), respectively, and the stacker partition frames 120 (FIG. 15) described below. A plurality of different size and type cover panels 73 (FIG. 1) are attachable to the partition frames to aesthetically cover the sides thereof. The partition frames 44, 45 and 120 are interconnectable in a myriad of different plan arrangements. Notably, in each of the plan agreements, the partition panels are readily interconnectable in discrete locations to form accurately dimensioned office spaces of a selectable size without the need to carefully/accurately measure with a tape measure or order new parts. This feature, in combination with the highly flexible and accurate interconnection systems, makes the present freestanding partition panel system 41 very functional, markedly accurate, and also highly flexible/reconfigurable into a wide variety of arrangements. The interchangeability and rearrangeability reduces the need to order a substantial number of new components when reconfiguring the office plan. Also, the major components of each of the partition frames 44 and 45 are manufactured by roll-forming, such that their cost, when produced at high volumes, is generally very competitive and their cross sectional accuracy and consistency much better than for frame components made by stamping processes.

Figure 40:
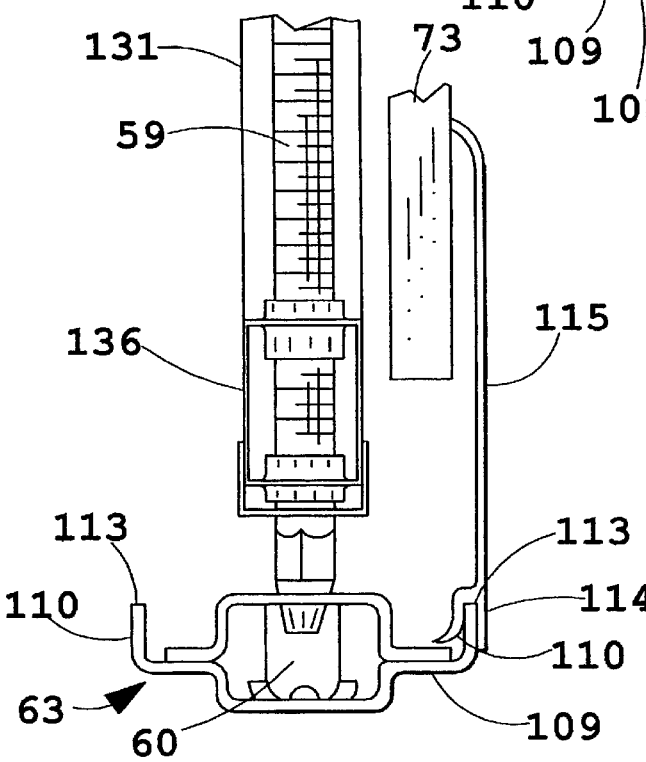
FIG. 40 is a fragmentary end view of the floor channel and partition frame including the leveler engaged therewith.
Figure 42:
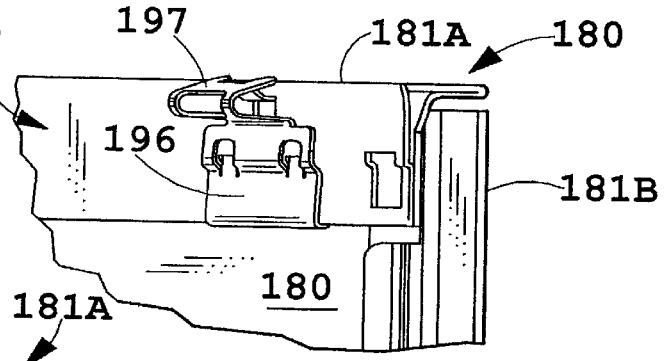
FIG. 42 is an enlarged perspective view of the circled area XLII in FIG. 41.
Figure 43:
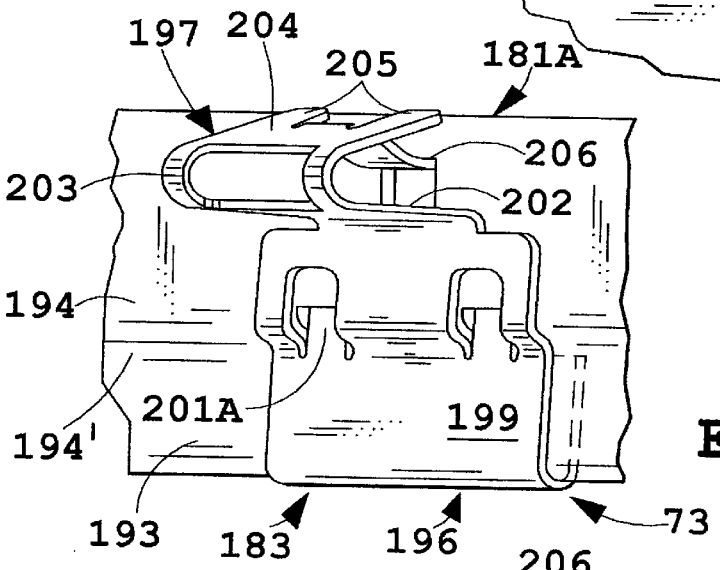
FIG. 43 is a further enlarged view of the cover-panel-supporting top connector and related cover panel structure of FIG. 42.

Four-inch base partition frames 44 (FIGS. 2–4) include at least two spaced-apart vertical uprights 46. A plurality of horizontal frame members 47–51 are attached to the uprights 46 at predetermined heights, as described below. The frame members 47–51 have front and rear faces spaced about 3 inches apart. The panel 42 becomes 3.8 inches thick upon attachment of cover panels 73, and 4 inches upon attachment of trim components. Levelers 52 are operably attached to the bottoms of the uprights 46, and are configured to be releasably secured to floor channel 53 (FIG. 40). The partition frames 44 are provided in a variety of different heights and lengths in order to meet customer demands concerning functional and aesthetic considerations in a modern office or building area. Notably, base partition frames can be constructed with all of the above horizontal frame members 47–51, or with only selected ones of the horizontal frame members, such as with only frame members 47, 48 and 51 (see FIG. 15).

Figure 4:
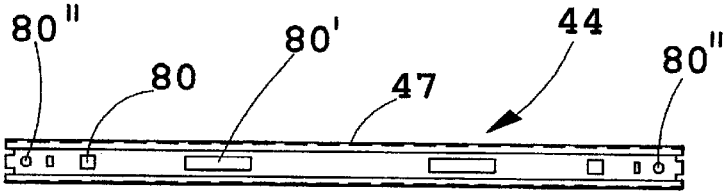
FIGS. 2–4 are side, end, and bottom views of a base frame shown in FIG. 1.
Figure 2:
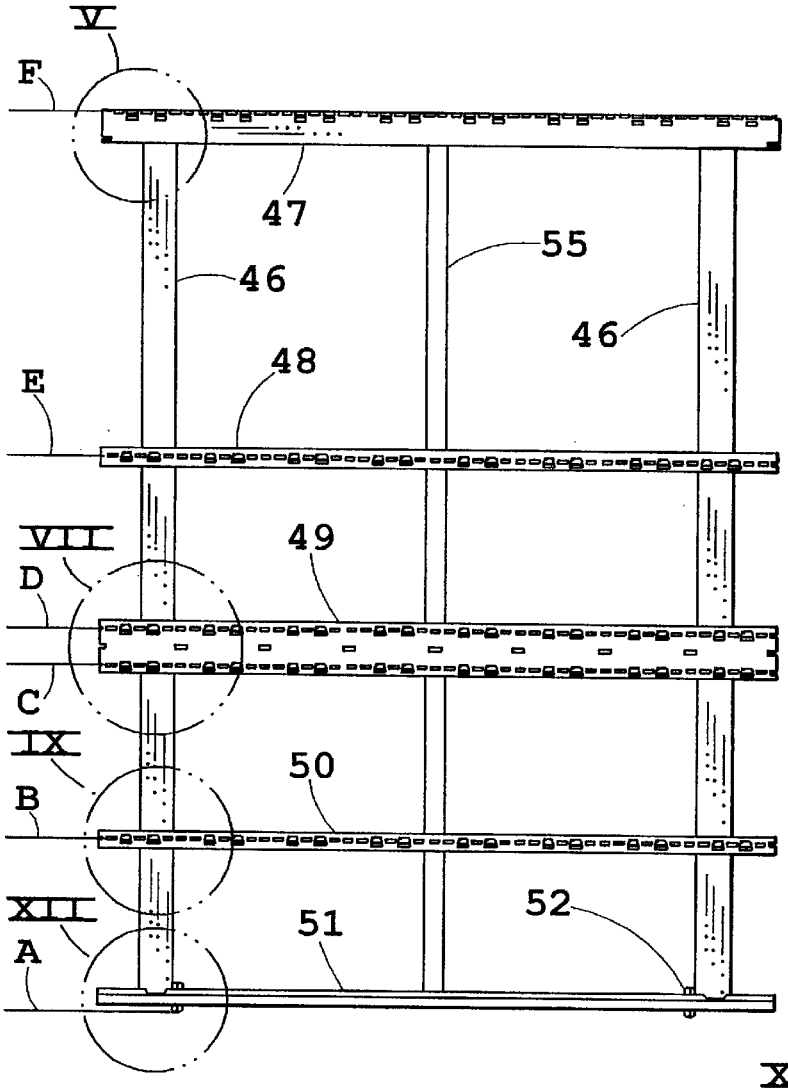
Figure 3:
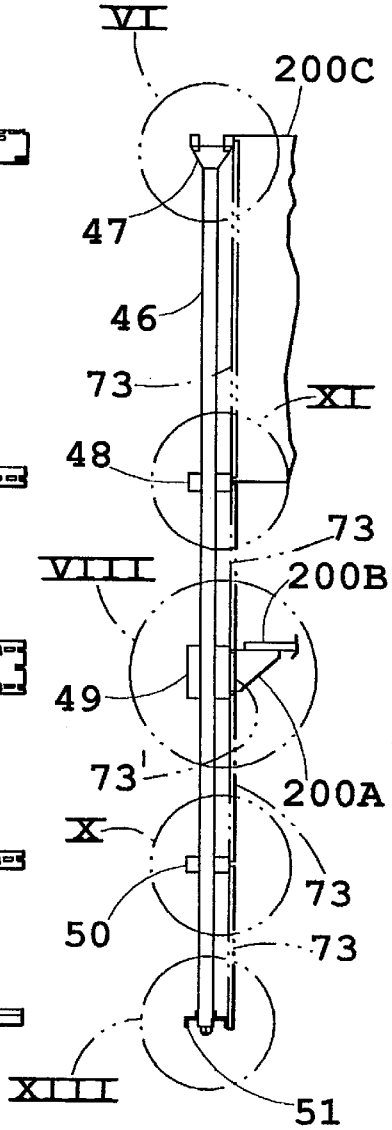
Figure 5:
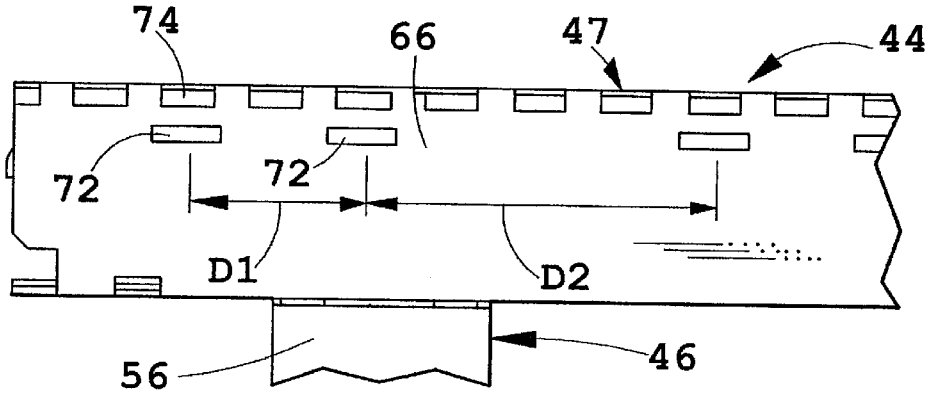
FIGS. 5–12 are enlarged fragmentary views of circled areas V through XII in FIGS. 2–4.
Figure 12:
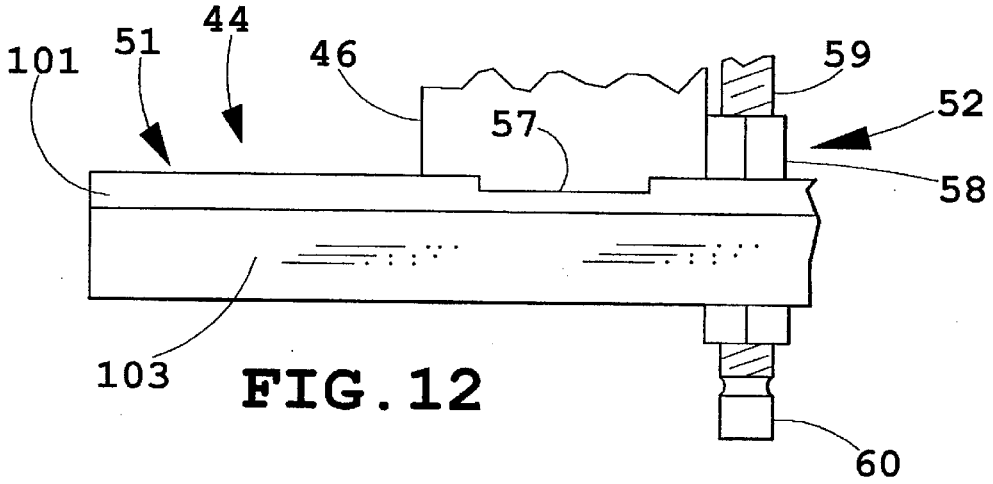

The outermost vertical uprights 46 (FIGS. 2–3) have rectangular cross sections. Intermediate uprights 55 are required when the horizontal span between uprights 46 reaches a relatively wide spanning distance. The spanning distance at which intermediate uprights are required depends on the functional requirements of the frame system and also on the material thickness and inherent strength of the partition frames. For example, intermediate uprights may be desired whenever the span between adjacent uprights reaches a distance greater than about two feet if the partition frame must support furniture components. Notably, the intermediate upright(s) can be rectangular or, alternatively as shown in FIGS. 2–4, they can have a square cross section. The uprights 46 (and 55) extend continuously from top to bottom of the partition frames 44. The upper end 56 (FIG. 5) of the uprights is butt welded/mig welded to a bottom of uppermost frame member 47, and the lower end 57 (FIG. 12) of the uprights is butt welded/mig welded between the pair of lowermost frame members 51. This provides a rigid but open frame. It also facilitates accurate and efficient manufacture since the uprights and horizontal frame members 47 and 51 can be accurately fixtured with the welding material taking up any dimensional variation in the length of the uprights. A hex nut 58 is welded to an inboard side of the lower end 57 of each of the uprights 46. A lower portion of the hex nut 58 extends slightly below the lowermost frame member 51, and a threaded rod 59 (FIG. 12) extends threadably through nut 58. The leveler rod 59 includes a configured end 60 shaped to matingly engage the small end of a key hole aperture 61 (FIG. 39) in a hat-shaped section 62 of a floor channel 63. A clip 64 secures the leveler rod 59 in the small end so that the leveler rod 59 is securely attached to the floor channel. When required by code, the floor channel 62 is secured in place by nailing, adhering, or otherwise fastening a bottom flange of the floor channel 62 to a building floor, so that the interconnected assembly of the partition frame 44 and floor channel 62 is resistant to damage/failure by a catastrophic event, such as an earthquake.

Figure 6:
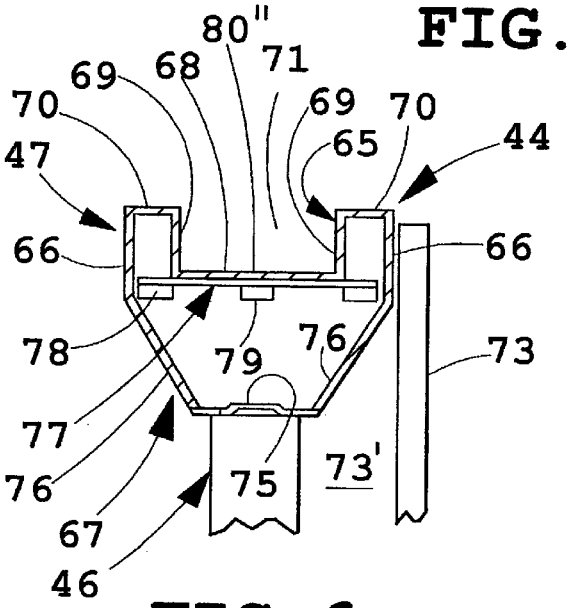
Figure 44:
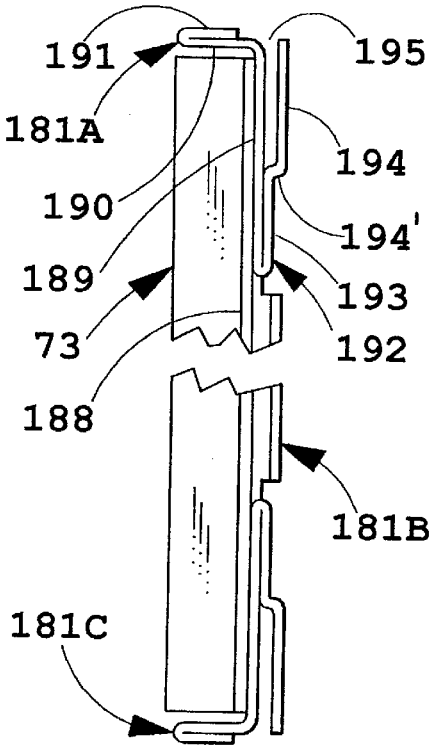
FIG. 44 is a side cross sectional view of the edging and body of the cover panel frame of FIG. 41.

The top horizontal frame member 47 (FIG. 6) is tubular, and is roll-formed to provide a cost efficient manufacturing process. Top frame member 47 includes a channel forming top section 65, opposing apertured sidewall sections 66 connected to the edges of the top channel section 65, and a U-shaped support section 67 for supporting opposing sidewall sections 66. More specifically, top channel section 65 includes a center flange 68 with apertures 80 to permit stacking connection and apertures 80' to permit routing of wires therethrough. Opposing vertical inner flanges 69 extend from center flange 68, and horizontal top flanges 70 extend outwardly from center flange 68. The inner flanges 69 combine with center flange 68 to define an upwardly open channel or raceway 71 adapted to receive wires laid in from above. Sidewall sections 66 extend vertically downwardly from flanges 70, and include cover-panel-supporting clip-receiving attachment apertures 72 (FIG. 5) for releasably receiving cover panel clip connectors (see FIG. 44). The cover panels 73 (FIGS. 1 and 41) comprise relatively flat panels adapted to cover the partition frames for aesthetics. Cover panels can be made from sheet metal, plastic, composite/particulate materials, other semisolid or structural materials, or combinations thereof. The cover-panel-supporting apertures 72 (FIG. 5) occur in pairs that are spaced about 2 to 3 inches "D1" apart, preferably 2.7 inches, with the pairs being spaced regularly horizontally apart about every 6 inches "D2" along the sidewall section 66.

A row of furniture-component-supporting hook-receiving attachment slots 74 extend horizontally along sidewall sections 66 just above apertures 72. The component-supporting slots 74 are adapted to receive horizontally oriented hooks on brackets for attaching furniture components to horizontal frame member 47, such as off-module attached partition frames, binder bins, shelves, and the like. The sidewall sections 66 are spaced outwardly from the sides of uprights 46 so that a cavity is formed between an inside surface of panels 73 and uprights 46, as discussed below.

U-shaped support section 67 (FIG. 6) of the top frame member 47 includes a flat bottom flange 75 and oppositely angled side flanges 76 that extend upwardly at about 60 degrees. The angled side flanges 76 support the sidewall sections 66 at a location spaced outwardly from the sides of uprights 46 (and 55) so that the cover panels 73 are spaced from the uprights 46 and 55 to create an internal cavity 73'. This cavity 73' is noticeably open and provides an open interior space well adapted to receive a high density of utilities. The utilities can be flexibly routed to substantially any location within frame 42 or to adjacent frames, and can include bundled wires or conduit covered wires of about 1 inch diameter. The angled flanges 76 provide a strut-like support for supporting sidewall sections 66, with an optimal distribution of stress. This, in combination with the tubular shape of top horizontal frame member 47, allows the sheet material forming the top tubular horizontal frame member 47 to be optimized to a relatively thin gauge. Bottom and top/center flanges 68 and 75 include square apertures 80 and rectangular apertures 80' for routing wire therethrough. The uprights 46 are welded to bottom flange 75 of support section 67.

The fact that top horizontal frame member 47 is tubular, and also the fact that it includes angled side flanges 76 along with its other flat flanges connected by work-hardened bends, causes top frame member 47 to be particularly strong and structurally stiff. This allows top frame member 47 to carry substantial weight, such as binder bins, shelves, and other hang-on furniture. The inherent strength of tubular top frame member 47 also stiffens the entire frame 44 against undesired bending and torsional deflection. As an example of the strength of tubular frame member 47 and its contribution to the strength of the frame 44, it is contemplated that the above-mentioned tubular top horizontal frame member 47 can be made from 18 gauge thickness (i.e., about 0.048 to 0.050 inches thickness) and still acceptably/stably support a 400 pound weight cantilevered several inches in front of the center of the frame member 47, with the frame member 47 supported at its ends and spanning about 48 inches or more. The support of the 400 pounds is provided without an objectionable amount of torsional or translational deflection of the tubular top horizontal frame member 47 (based on conservative standards for load-bearing, freestanding partition panels). This contrasts with conventional freestanding partition panels constructed to bear weight that typically are made of 16 gauge thickness (i.e., about 0.060 inches thickness) in order to meet similar load/deflection standards. The fact that tubular top horizontal frame member 47 includes apertured sidewalls 66 with sheet metal material extending from its top to its bottom, and the fact that top horizontal frame member 47 does not include an excessively elongated access slot (such as is characteristic of rails, as discussed in the background of this disclosure), results in the top horizontal frame member 47 being particularly strong.

Figure 30:
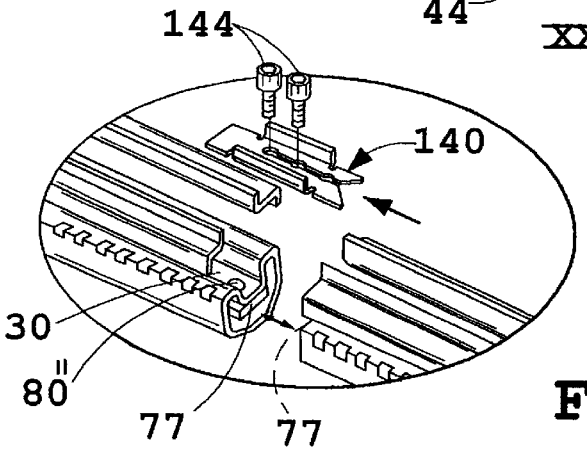

A platform bracket 77 (FIG. 6) is optionally welded to an underside of center flange 68 of top channel section 65 inside of tubular top horizontal frame member 47. Bracket 77 includes stiffening flanges 78 on at least the side of each end, and further includes an extruded hole 79 that aligns with a hole 80" in center flange 68. The extruded hole 79 is located a short distance (i.e., an inch or so) from the end of center flange 68. The bracket 77 reinforces center flange 68. The extruded hole 79 threadably engages a screw 144 (FIG. 30) for providing in-line connection (FIGS. 27–30) and off-module connection (FIGS. 32–35) of partition frames, as described below.

Figure 38:
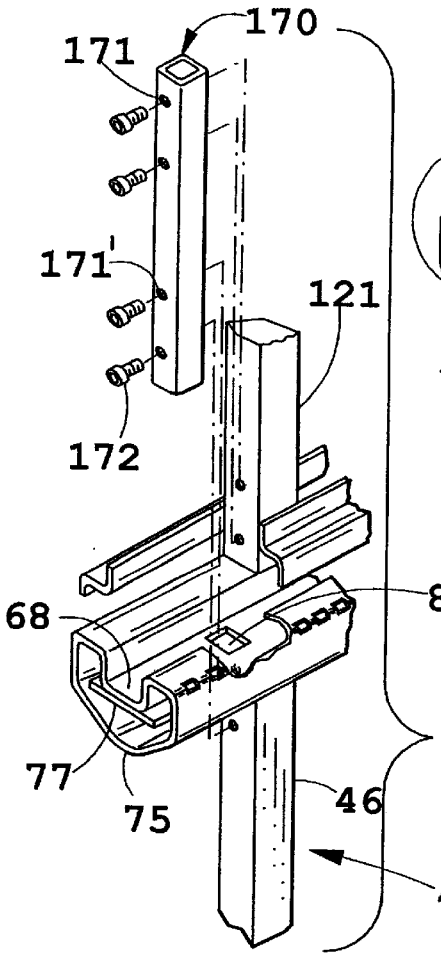
FIG. 38 is a fragmentary exploded view of the circled area XXXVIII in FIG. 29, including the stacker bracket for connecting same in a stacked arrangement.

The pair of vertically aligned square holes 80 (FIG. 38) are located in center flange 68 and bottom flange 75 near the ends thereof at a location inboard of but vertically proximate the ends of uprights 46. The holes 80 are configured to closely receive a tubular stacker bracket 170 (see FIGS. 29 and 38) that attaches to the inboard side of an upright 46 of base frame 44 and is an inboard side of an upright 121 of a stacker frame 120, as discussed below.

Figure 37:
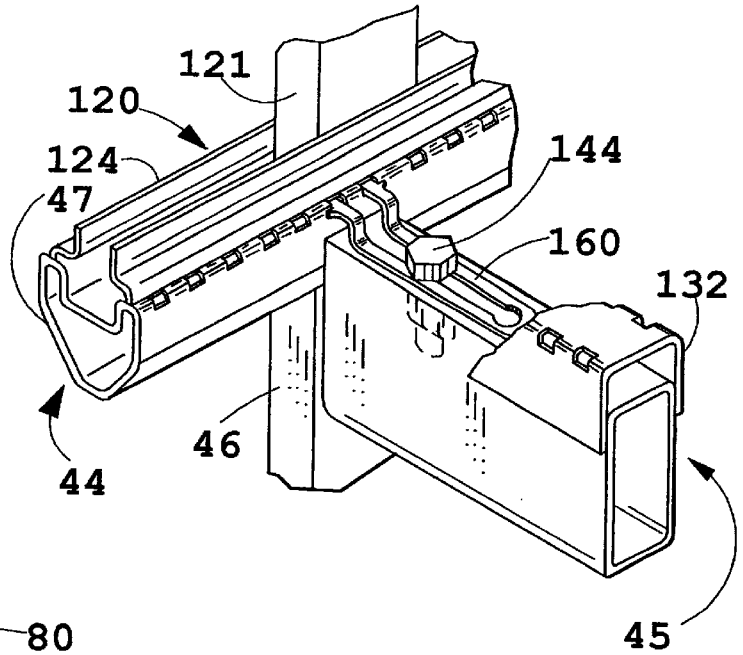
FIG. 37 is a fragmentary perspective view, partially broken away, of a two-inch partition frame connected off-module to a four-inch partition frame using the off-module connector of FIG. 36.

The belt-high horizontal frame members 49 (FIGS. 7–8) include two rectangular tubes mig welded on opposite sides of uprights 46 and 55. The frame members 49 each include an outer planar face 82 defining a row of panel-cover-supporting apertures 83 proximate a top of the frame members 49 for releasably receiving cover panel clip connectors. As with apertures 72 above, the cover-panel-supporting apertures 83 occur in pairs that are spaced about 2 inches apart, and the pairs are spaced regularly horizontally about every 6 inches along the outer planar face 82. A row of furniture-component-supporting hook-receiving slots 84 extend horizontally along faces 82 just above cover-panel-supporting apertures 83. The component-supporting slots 84 are adapted to receive horizontally oriented hooks on brackets (e.g., brackets 150, FIG. 33, or bracket 160, FIG. 37) for attaching furniture components to horizontal frame members 49, such as off-module attached partition frames, binder bins, shelves, and the like. The particular component-supporting slots 84' located above cover-panel-supporting apertures 83 include a vertically extending notch 85 that can be used to access an inside of frame member 49. Another row of cover-panel-supporting clip-receiving apertures 86 and another row of component-supporting slots 87 extend horizontally along a lower portion of frame members 49. The pattern of apertures/slots 86 and 87 are identical to the pattern of apertures/slots 83 and 84, and are vertically aligned therewith.

Figure 1:
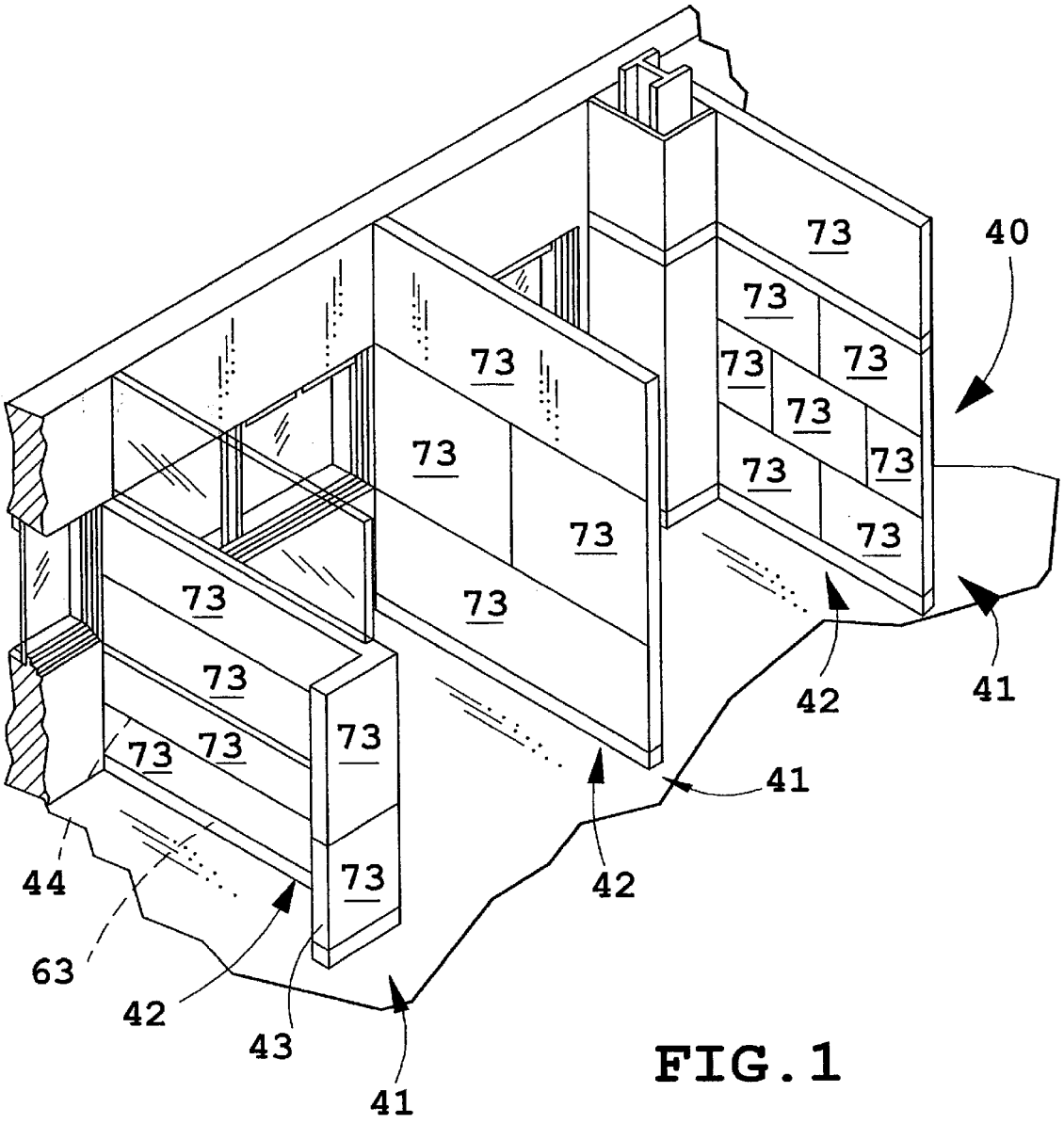
FIG. 1 is a perspective view of a partition system embodying the present invention.

The arrangement of apertures/slots allows cover panels 73 to be attached to the frame 44 in different arrangements. Several such cover panel arrangements are shown in FIG. 1. For example, a single cover panel can be attached that completely covers the frame 44 from top to bottom. If an intermediate clip is needed to retain the cover panel to the frame 44, then it is positioned to engage one of the apertures 83 or 86. Alternatively, a partial height top cover panel can be attached to frame 44, with its bottom edge located just above bottom slots 87. For example, in the partial height arrangement, attachment clips on the top partial height cover panel engage notches 85. A partial height bottom cover panel is then attached that has a top edge located just below the bottom component-supporting slots 87. This leaves the bottom component-supporting slots 87 continuously exposed, even with the top and bottom cover panels on the frame 44. Thus, furniture components can be attached to or removed from the frame 44 without disturbing the cover panels 73.

In still another alternative (see FIG. 3, covers shown in phantom lines), a partial height top cover panel 73 has a bottom edge that is located above the top component-supporting slots 84, and a partial height bottom cover panel has a top edge that is located below the bottom component-supporting slots 87. A short-height concave beltway panel cover 73' of about 3 inches height or so is attached between the cover-panel-supporting slots 83 and notches 88, leaving the component-supporting slots 84 and 87 exposed. In such arrangement, furniture components can be attached to one or both of the slots 84 and 87, even while the concave 3 inch cover panel is still attached. See application Ser. No. 08/701,664, filed Aug. 22, 1996, entitled RECONFIGURABLE SYSTEM FOR SUBDIVIDING BUILDING SPACE AND HAVING MINIMAL FOOTPRINT, which was previously incorporated herein by reference. This double set of component-supporting slots 84 and 87 is particularly advantageous for use to support shelf-supporting cantilevered brackets 200A and shelves 200B (FIG. 3) in front of horizontal frame member 49, as described in U.S. application Ser. No. 08/701,664. Notably, a fifth row of apertures 89 are located longitudinally along a center line of face 82 at 6 inch spaced apart intervals. These apertures 89 are engaged by spring clips on the beltway panel cover to hold the beltway cover on frame 44. When installed, the outer surface of the beltway cover is flush with cover panels 73, or can be recessed therefrom. Even with cover panels 73 attached, the furniture-component-supporting slots (e.g. slots 72 and 84) can be accessed by hooked brackets to support binder bins 200C (FIG. 3) or the like.

Figure 9:
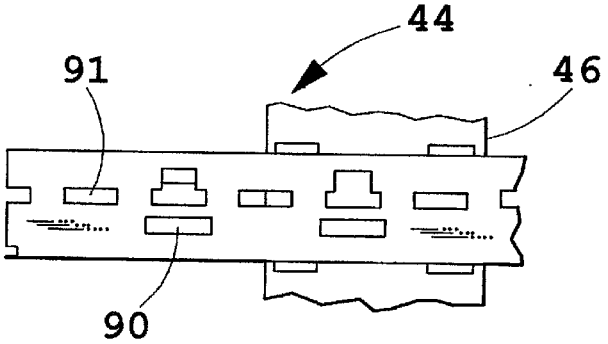
Figure 10:
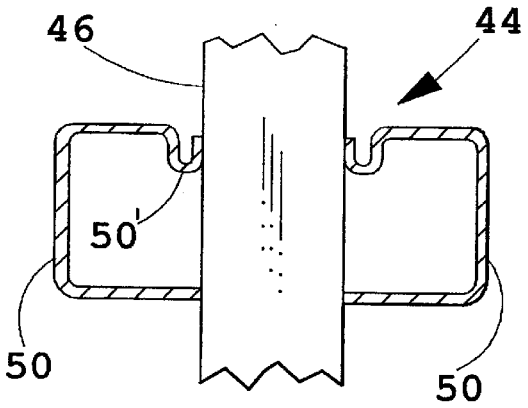
Figure 11:
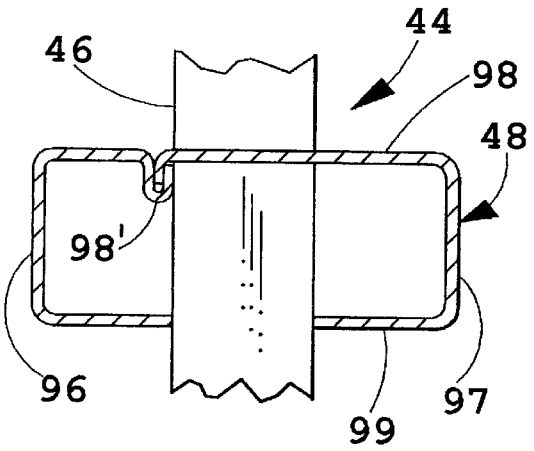

The knee-high horizontal frame members 50 (FIGS. 9–10) comprise a pair of inwardly facing C-shaped channels welded onto opposite sides of uprights 46 (and 55). A stiffening rib 50' is optionally formed on the C-shaped channel if needed. In still another alternative, a bracket is welded or secured to the uprights 46 having outwardly extending legs, and the C-shaped channels are hooked onto legs of the brackets. In still a third alternative, the frame member 50 is a single rectangular tube, much like tube 48 in FIG. 11, described below. Regardless of their particular cross sectional shape, it is contemplated that the frame members 50 will have a pattern of cover-panel-supporting apertures 90 and component-supporting slots 91 that form an identical pattern to the cover-panel-supporting apertures 83 and component-supporting slots 84 on belt-high horizontal frame member 49. The purpose and function of the cover-panel-supporting apertures 90 and component-supporting slots 91 are identical to cover-panel-supporting apertures 83 and component-supporting slots 84.

The shoulder-high horizontal frame member 48 (FIG. 11) is used where the uprights are so long that the top horizontal frame member 47 is spaced significantly above belt-high horizontal frame member 49. The shoulder high horizontal frame member 48 is also desirable where an intermediate support for furniture components is desired. The frame member 48 is a rectangular tube having opposing apertured planar side faces 96 and 97 that are identical to the outward faces of knee-high horizontal frame members 50. However, horizontal frame member 48 is rectangular, and includes top and bottom horizontal transverse flanges 98 and 99 that extend from front to rear of frame 44, and interconnecting vertical faces 96 and 97. The top and bottom horizontal flanges 98 and 99 are cut out to form apertures at their ends and middle to mateably receive and engage uprights 46 and 55. It is noted that the bottom flange 99 can comprise two separate and unconnected flange sections that terminate in inward edges that abut the outboard sides of the uprights 46 and 55. Also, the top flange 98 can include a doubled-back stiffening rib 98' formed to lie adjacent an edge of the uprights 46 and 55. The top and bottom flanges 98 and 99 are mig welded or otherwise securely attached to uprights 46 and 55.

Figure 13:
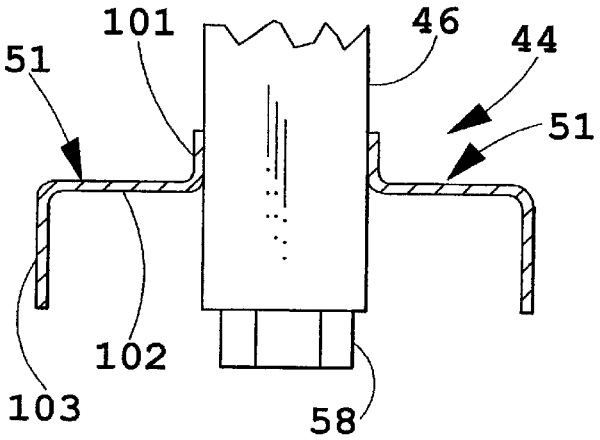
FIG. 13 is a fragmentary end view of FIG. 12.
Figure 14:
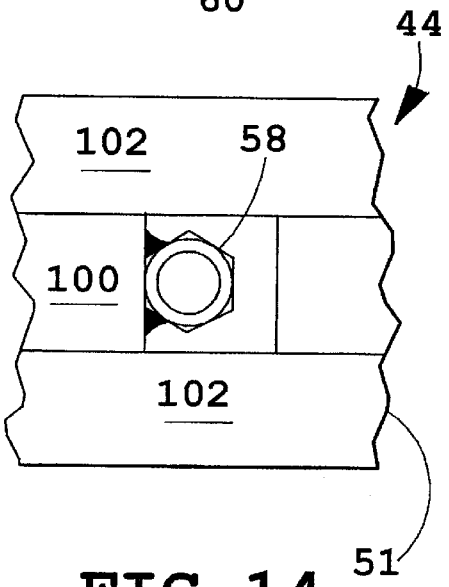
FIG. 14 is a fragmentary bottom view of FIG. 12.

The floor-adjacent horizontal frame members 51 (FIGS. 12–13) are opposing Z-shaped members, having an inner flange 100 for engaging uprights 46 and 55. Lateral flanges 102 extend horizontally from inner side flanges 101, and outer vertical side flanges 103 extend vertically from lateral flanges 102. Floor-adjacent horizontal frame member 51 can include cover-panel-supporting apertures and component-supporting slots similar/identical to cover-panel-supporting apertures 83 and component-supporting slots 84 if desired (see FIG. 7). In the illustrated embodiment, the bottom edge of vertical side flanges 103 is constructed to engage bottom cover-panel connector clips 184 to retain a lower edge of the cover panels 73 attached at the bottom of the frame.

Figure 22:
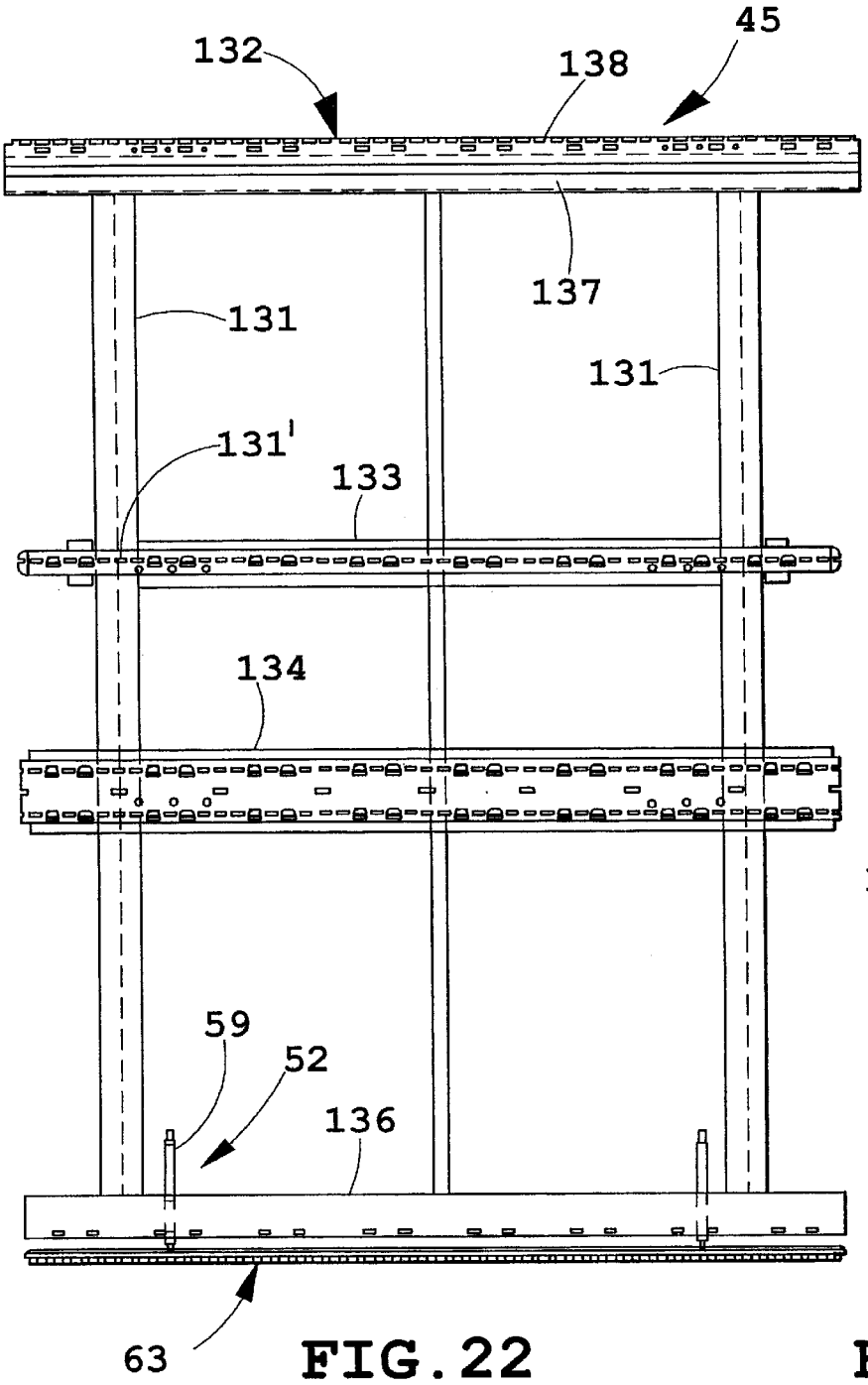
Figure 39:
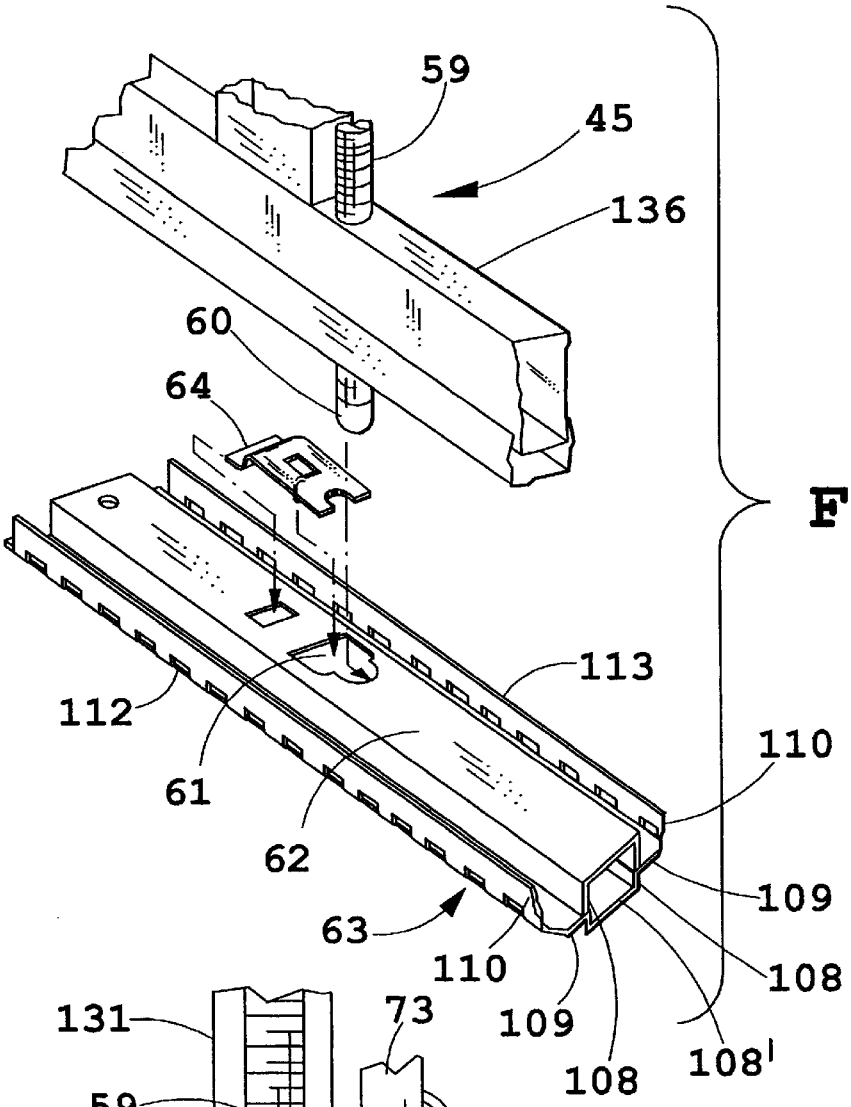
FIG. 39 is a fragmentary exploded view of the floor channel and the leveler on the partition frame of FIG. 22 for engaging the floor channel.

An exemplary floor channel 63 is shown as supporting a two-inch partition frame 45 in FIGS. 22 and 39–40. A similar floor channel can be constructed for engagement with a four-inch partition frame 44. Floor channel 63 (FIG. 39) includes a center section with a raised center flange 62, inner side flanges 108, and a bottom flange 108'. Flanges 109 extend horizontally outwardly from inner side flanges 108, and freestanding outer flanges 110 extend upwardly from the edges of floor engaging flanges 109. The outer flanges 110 include component-supporting slots 112 for receiving furniture component brackets. Also, the upper edge 113 of outer flange 110 is adapted to releasably receive friction/snap-attach connectors 114 on a baseboard-simulating cover plate 115, as described in U.S. application Ser. No. 08/689,913, previously incorporated herein by reference. It is noted that the present floor-channel attachment system can be used on a variety of different floor channel configurations, including those having a relatively flat and wide floor-engaging flange that extends completely from a front to a rear of the floor channel.

The component-receiving apertures of the horizontal frames members 47–51 are strategically positioned to reflect a predetermined vertical dimensional logic. Further, the horizontal frame members 48–51 are fixtured relative to the top flat surface of the top frame member 47 and are accurately located relative to the apertures 72/74 so that the vertical dimensional spacing of all apertures in frame members 47–51 is accurately controlled. Notably, this arrangement allows the length of uprights 46 to vary without adversely affecting the location of the various apertures. Specifically, as shown in FIG. 2, the apertures are located so that a dimension of about 12 to 13 inches exists between apertures at location A and location B, between location B and location C, and between location D and location E. Also, the distance between location E and location F in the illustrated frame 44 is twice the dimension between locations A and B. This allows a "1X" cover panel having a dimension equal to the distance A-B to be used to cover any of the spans from locations A-B, B-C or D-E. A "2X" or double-height-type cover panel can be used to cover spans from locations A-C or E-F. A "1X plus" cover panel can be used to span locations B-D or locations C-E. A "2X plus" cover panel can be used to span locations A-D or locations B-E. Notably, the overall height of partition frames 44 can be varied. In such case, it is advantageous to design the top frame member 47 to be at a height that is above the next-to-top horizontal frame member by a distance equal to the distance B-C, or by the distance B-D, or some logical multiple/variation thereof. This advantageously allows a relatively limited number of cover panels to cover all different partition frame constructions while still being able to achieve desired ergonomically correct space division heights. Thus, this scheme greatly reduces inventory management in the factory and on-site, simplifies ordering and shipping, and also greatly simplifies manufacturing, particularly since the cover panels can be covered with a myriad of different materials and/or different structural compositions.

Figure 17:
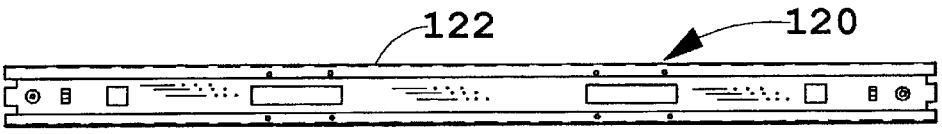
FIGS. 15–17 are side, end and top views of the stacker frame shown in FIG. 1.
Figure 16:
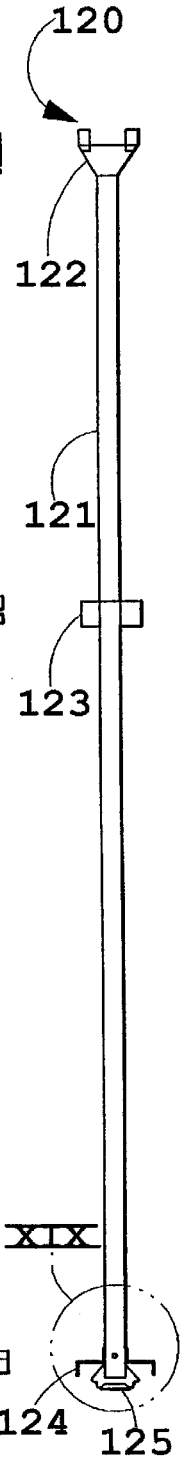

The partition panels 42 also include a stacker partition frame 120 (FIGS. 15–17) adapted to be stacked above the base partition frames 44. The stacker partition frame 120 includes uprights 121 identical to uprights 46 of base partition frames 44, and further includes horizontal frame members comparable to any of horizontal frame members on base partition frame 44. The particular horizontal frame members of stacker partition frame 44 depend upon the functional requirements of stacker partition frame 120, and also upon its vertical height, longitudinal length, and other functional/size/spacial requirements. The illustrated stacker partition frame 120 includes a top horizontal frame member 122 structurally identical to top horizontal frame member 47 of base partition frame 44, an intermediate horizontal frame member 123 identical to horizontal frame members 48 or 50 of base partition frame 44, and a bottom horizontal frame member 124 structurally identical to bottom horizontal frame members 51 of base partition frame 44.

Figure 18:
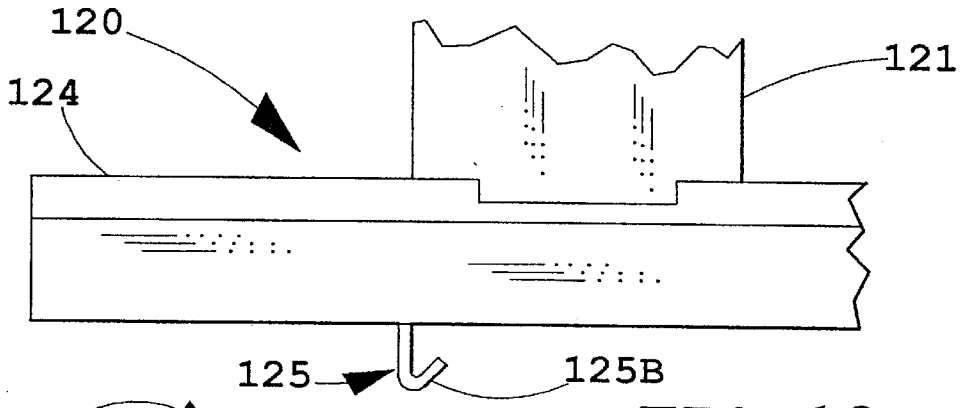
FIGS. 18–19 are enlarged views of the circled areas XVIII and XIX in FIGS. 15–16, respectively.
Figure 19:
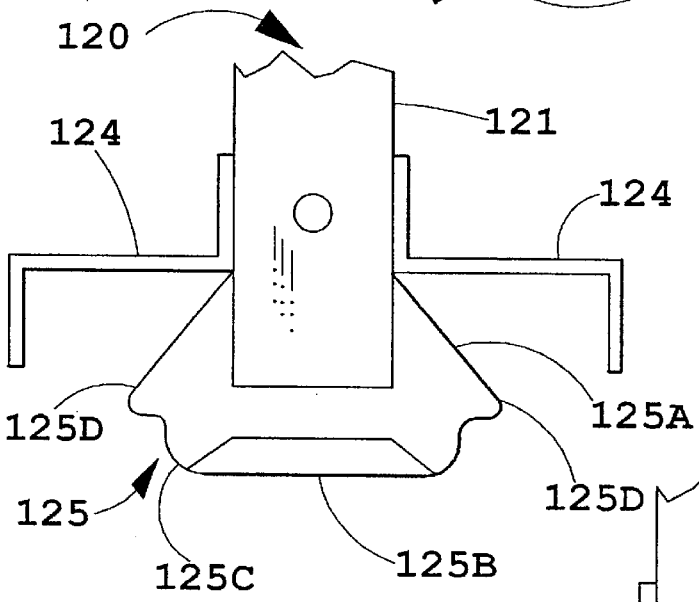
Figure 20:
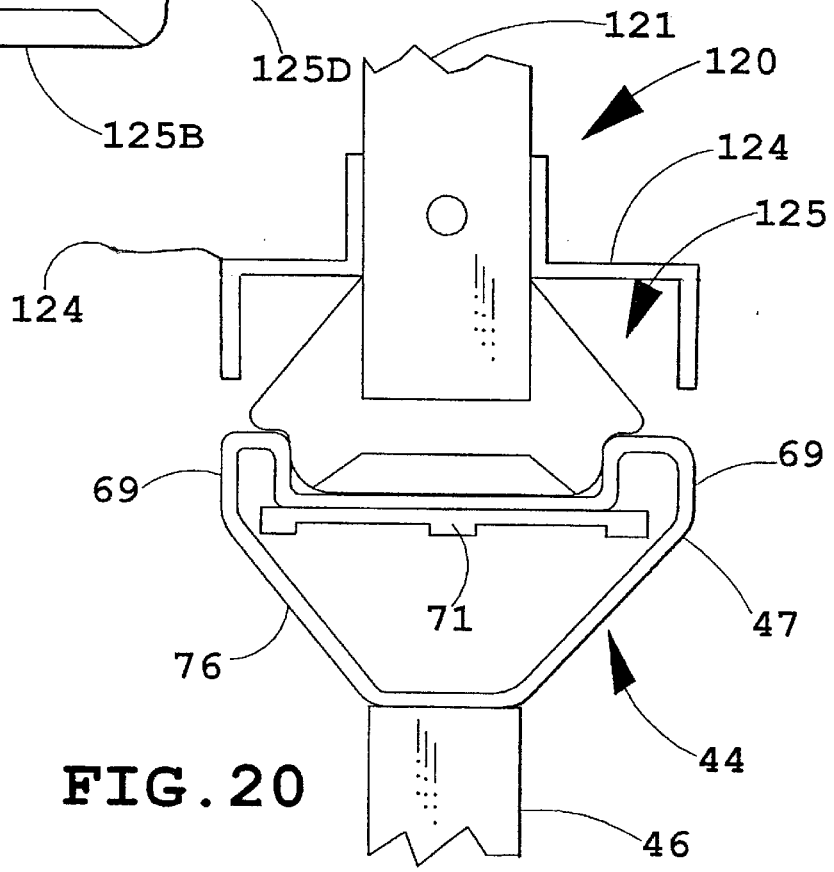
FIG. 20 is a fragmentary end view of the stacker frame shown in FIG. 18, with a locator on the stacker frame engaging the top of a base frame from FIG. 3.

Notably, stacker frame 120 does not include a leveler. Instead, stacker frame 120 includes downwardly extending alignment feet or locators 125 (FIGS. 18–19) welded or otherwise securely attached to the bottoms of horizontal frame member 124 of stacker frame 120. Specifically, locators 125 include a plate 125A welded to a bottom of the bottom horizontal frame member 123. A rounded J-shaped flange 125B is formed at a bottom of plate 125A, the flange 125B having a long width dimension that extends transversely from a front to a rear of the stacker frame 120. The locator flange or foot 125B is adapted to fit mateably into and extends across channel 71 of top horizontal frame member 47 of base partition frame 44 when stacker partition frame 120 is attached to base partition frame 44 (FIG. 20). During assembly, the rounded bottom edges 125C of foot 125B engage the sidewall inner flanges 69 and cause the stacker partition frame 120 to ramp to a centered position on base partition frame 44 as stacker partition frame 120 is set on base partition frame 44. As locators 125 fully seat into channel 71, opposing wings 125D engage the top of flanges 70 of top frame member 47. Thereafter, a stacker bracket or connector 170 (FIGS. 29 and 38) is secured/bolted to inboard sides of the aligned abutting uprights 46 and 121 of the base and stacker partition frames 44 and 120, respectively. The stacker brackets 170 hold the stacker partition frame 120 securely, rigidly on the base partition frame 44.

Figure 21:
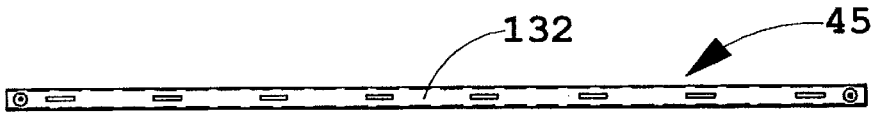
FIGS. 21–23 are top, side and end views of a two-inch wide frame embodying the present invention.
Figure 23:
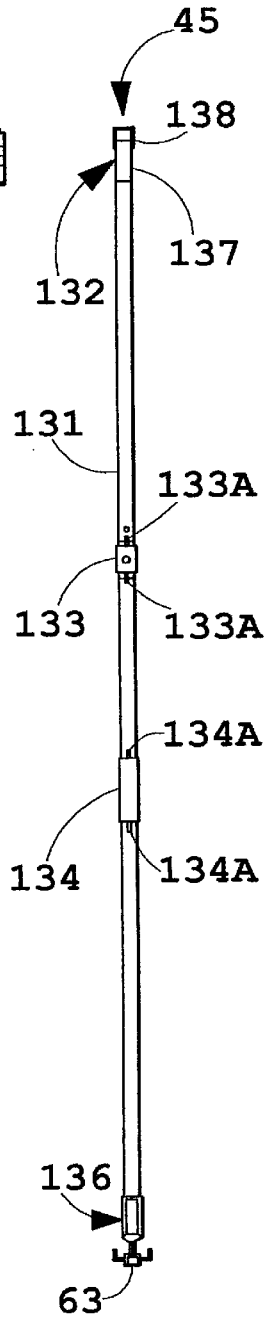

The two-inch partition panel 43 (FIG. 1) is described in detail in U.S. application Ser. No. 08/686,913, the entire contents of which were previously incorporated herein by reference. Briefly, the present modified two-inch partition panel 43 (which becomes "two inches" only after attachment of the cover panels) includes a partition frame 45 (FIGS. 21–23) having uprights 131 similar to uprights 46 of zone-wall partition frame 44. However, the horizontal frame members 132–136 have a narrow width that only exceeds the width of the uprights 131 by two thicknesses of sheet metal, one thickness being on each side of the uprights 131, at location 131' for example. Thus, the partition panel 43 formed by attachment of cover panels 46 to the sides of partition frame 45 is only about 2 inches thick in total width. Notably, the same cover panel 73 can be attached to two-inch frame 45 as is adapted to attach to four-inch frame 44. The top horizontal frame member 132 includes a rectangular tubular member 137 and a U-shaped channel 138 welded to the tubular member 137. Bottom horizontal frame member 136 similarly includes a rectangular tubular member 139. A U-shaped channel (not shown) similar to U-shaped channel 138 can be welded to a bottom of the tubular member 139 if desired. The intermediate horizontal frame members 133–134 each comprise opposing hat-shaped channels, having notches cut away to receive the uprights 131. The legs 133A and 134A of opposing ones of the hat-shaped channels abut, and are welded together and to the uprights 131. Connector-receiving apertures for supporting cover panels 73, and also hook-receiving slots for receiving hooked brackets to support furniture components, are formed in the sides of the horizontal frame members 132–134 and 136. It is contemplated that a pattern of apertures/slots similar to those found on partition frames 44 will be formed in frames 45, although various aperture/slot patterns are possible. Typically, the horizontal frame members of partition frame 45 horizontally align with the horizontal frame members of the partition frame 43, although this is also not absolutely necessary.

It is contemplated that a two-inch wide stacker frame can also be constructed if desired. The contemplated two-inch wide stacker frame is very similar to the two-inch wide base partition frame 45, but it includes holes adapted to receive a rod-like stacking connector similar to stacking connector 170.

Figure 24:
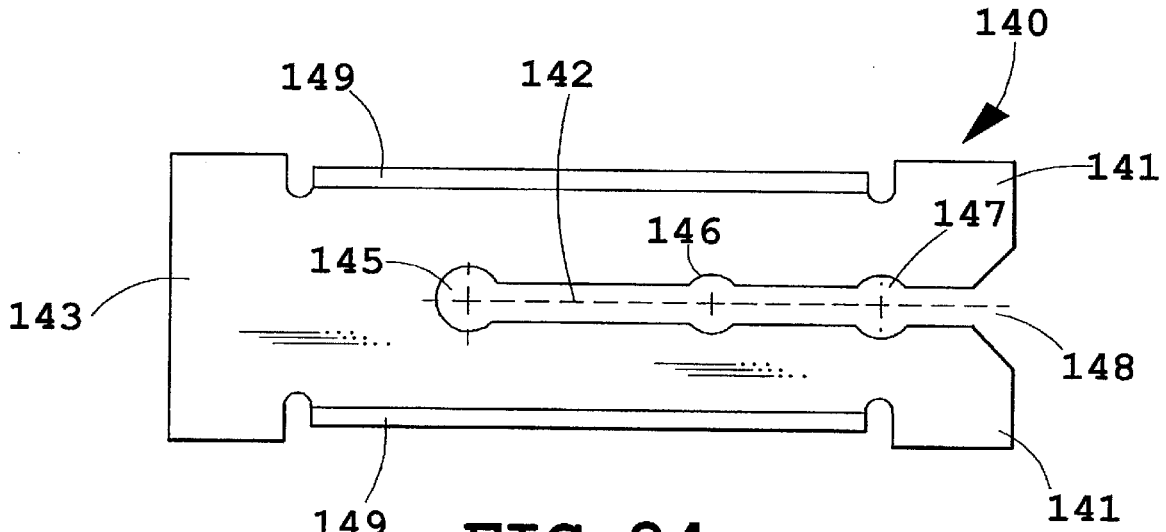
FIGS. 24–26 are top, side and end views of an in-line connector.
Figure 25:
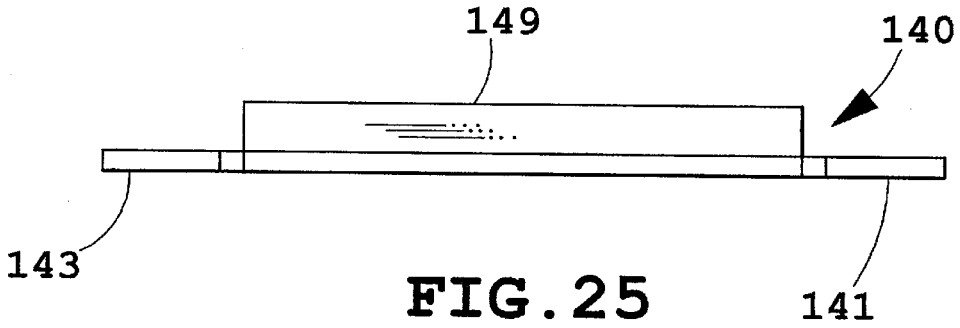
Figure 26:
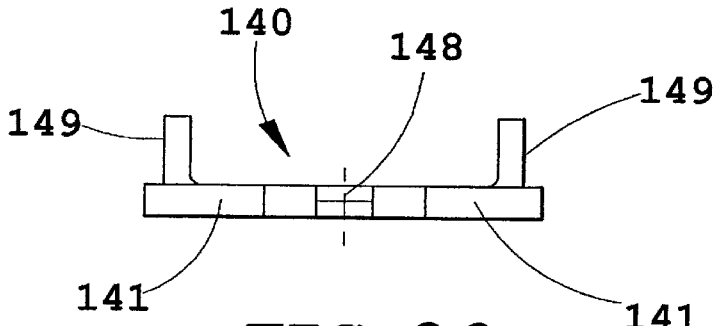
Figure 27:
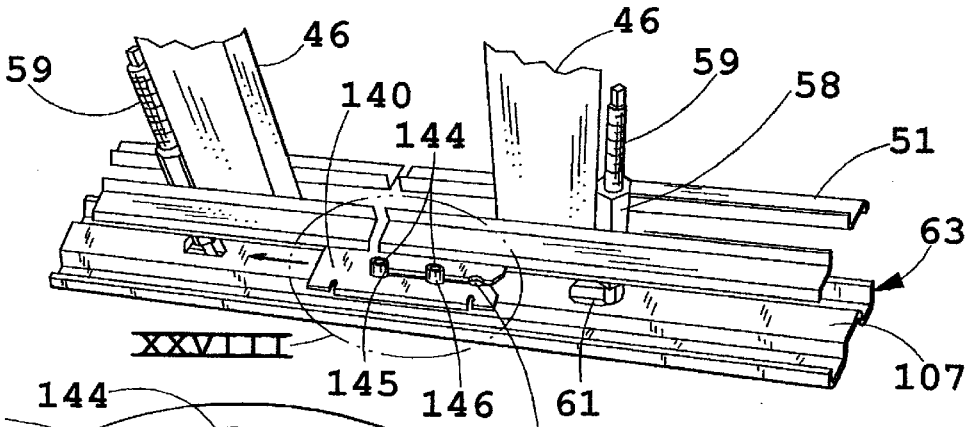
FIGS. 27–28 are fragmentary views showing in-line connection of two aligned partition frames from FIG. 2 at a floor location, FIG. 28 being an exploded view of the circled area XXVIII in FIG. 27.
Figure 28:
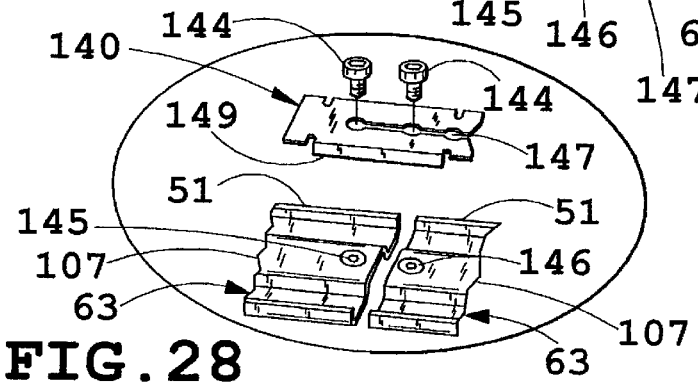
Figure 29:
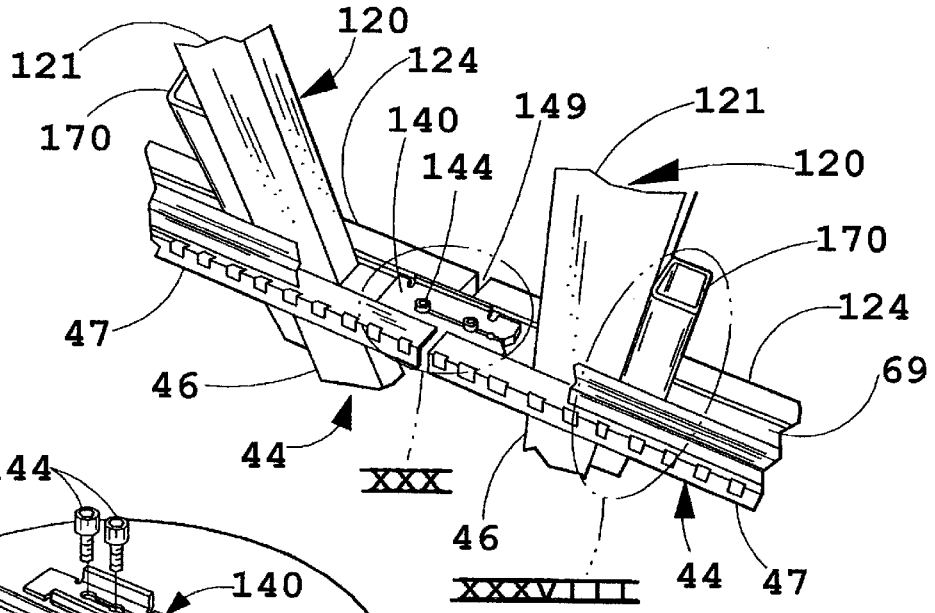
FIGS. 29–30 are fragmentary views showing in-line connection of two aligned partition frames from FIG. 2 at a belt-high location, including an in-line connector interconnecting two top horizontal frame members of in-line base partition frames, FIG. 29 also shows stacker partition frames, partially broken away, setting on the base frames, FIG. 30 being an exploded view of the circled area XXX in FIG. 29.

An in-line connector 140 (FIGS. 24–26) is adapted to interconnect aligned and adjacent four-inch partition frames 44. The in-line connector 140 includes a pair of legs 141 separated by a slot 142 and connected together at one end by a flat section 143. The slot 142 has a width that is less than the shaft of a connector bolt 144 used to clampingly secure the in-line connector 140 to a partition frame 44. However, three enlarged pockets 145–147 are formed along the slot 142 for receiving the shaft of the connector bolt 144, for reasons described below. The pocket 145 is formed at a base of the slot 142. Pocket 146 is formed about midway along slot 142 but shy thereof. The outermost pocket 147 is formed about halfway between the open end of the slot 142 and its middle point. The open end 148 of the slot 142 is angled outwardly to create a mouth. Reinforcing ribs 149 are formed along the outer sides of the legs 141 to stiffen the legs. The flat section 143 has a width about equal to the outer edge of the legs 141, and which is about equal to but slightly less than the width of the channel 71 in top frame member 47.

Two or more in-line connectors 140 (FIGS. 27–30) are used to connect a pair of base partition frames 44 as follows. At the floor level (FIG. 27), an in-line connector 140 is inverted so that the reinforcing ribs 149 straddle the raised center flange 107 of the floor channel 63. The in-line connector 140 is moved so that the pockets 145 and 146 (FIG. 28) align with extruded holes in the raised center flanges 107 of adjacent floor channels 63. Self-tapping screws 144 are extended into the extruded holes in the adjacent floor channels 63. The shafts of the screws 144 are large enough so that the in-line connector 140 cannot be removed even if the screws 144 become loose. However, the screws 144 clampingly retain the in-line connector 140 as well. Notably, the in-line connector 140 can be stored on a floor channel 63 by removing the screws 144, by telescopingly retracting the in-line connector completely onto the floor channel 63, and by thereafter extending the screw 144 through the end-most pocket 147. This locates the in-line connector 140 in a storage position wherein it is located entirely inside of the footprint of the end of the floor channel 63 in a convenient location for later use.

A second in-line connector 140 (FIG. 29) is located on center flange 68 of top horizontal frame member 47 (under the center flange of bottom horizontal frame member 51). The reinforcing ribs 149 of this second in-line connector 140 are positioned between vertical inner flanges 69. The second in-line connector 140 is moved so that the pockets 145 and 146 align with extruded holes in the center flange 68 of adjacent base partition frames 44. Self-tapping screws 144 are extended into the extruded holes. The shafts of the screws 144 are large enough so that the inline connector 140 cannot be removed even if the screws 144 become loose. However, the screws 144 clampingly retain the in-line connector 140 as well. Notably, the in-line connector 140 can be stored on a base partition frame 44 by removing the screws 144, by telescopingly retracting the in-line connector into the base partition frame 44, and by thereafter extending the screw 144 through the end-most pocket 147. This locates the in-line connector in a storage position wherein it is located entirely inside of the footprint of the end of the base partition frame 44. Where stacker partition frames 120 are used, an additional in-line connector 140 is attached in the top horizontal frame member 122, in a manner identical to the described manner for the top horizontal frame member 47 of base partition frame 44.

Figure 31:
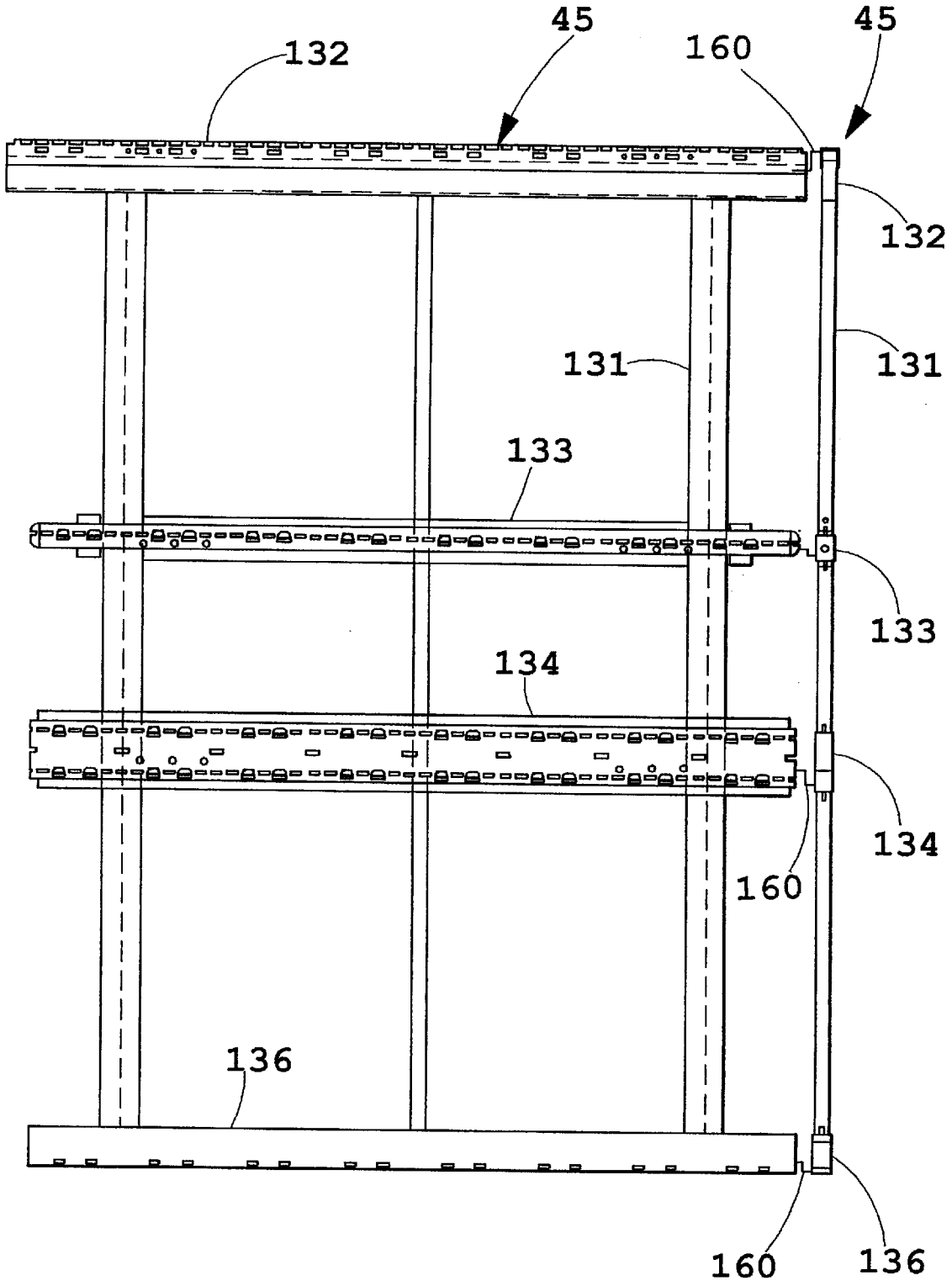
FIG. 31 is a perspective view showing an off-module connection of two partition frames from FIGS. 22–23.
Figure 32:
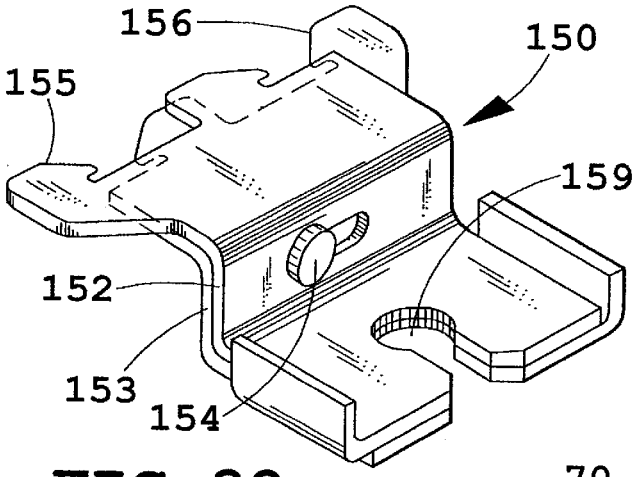
FIG. 32 is a perspective view of an off-module connector for interconnecting two four-inch partition frames in an off-module connected arrangement.
Figure 36:
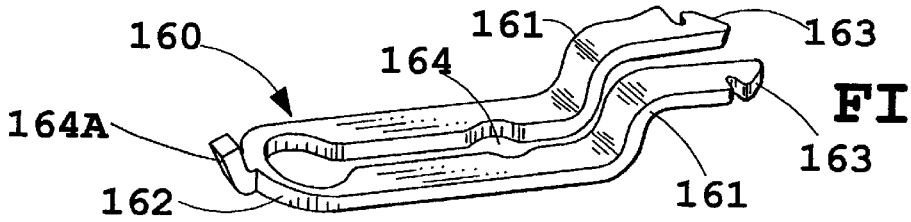
FIG. 36 is a perspective view of an off-module connector for interconnecting a two-inch partition frame to another partition frame in an off-module connected arrangement.

Advantageously, the partition frames 44 and 45 (and including associated stacker frames) can be attached to each other in a variety of off-module arrangements, including finwall to finwall (FIG. 31), finwall to zonewall (FIG. 1), zonewall to zonewall (FIG. 33), and zonewall to finwall connections. For this purpose, two different off-module connectors 150 (FIGS. 32–35) and 151 (FIGS. 36–37) are provided, each being adapted with hooks at one end to engage slots in the partition frames, and being adapted at their other ends to engage an end of a partition frame 44 or 45.

Figure 33:
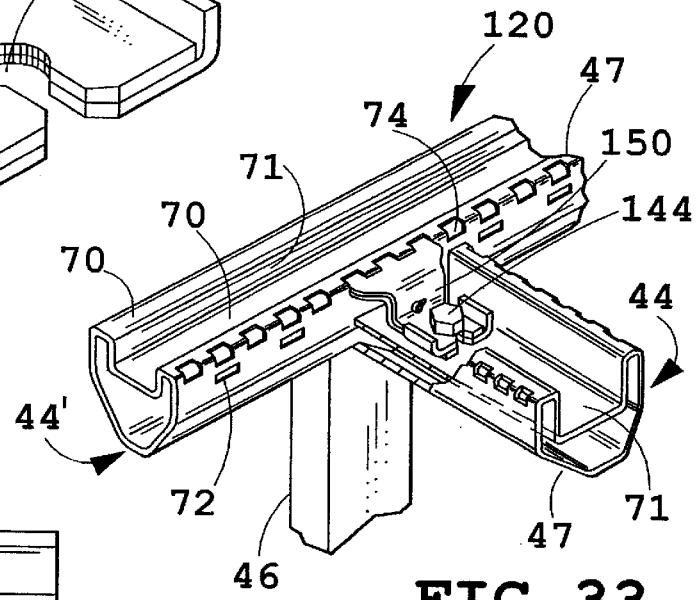
FIG. 33 is a fragmentary view, partially broken away, of a top of a first four-inch partition frame interconnected to a top of a second four-inch partition frame in an off-module connected arrangement.
Figure 34:
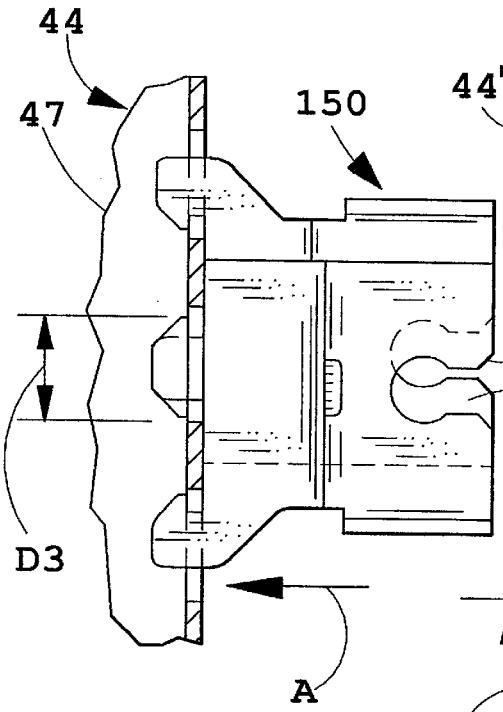
FIGS. 34 and 35 are fragmentary top views of an off-module connector that is connected to a partition frame, the off-module connector being in an unlocked/released position in FIG. 34 and in an interlocked/engaged position in FIG. 35.
Figure 35:
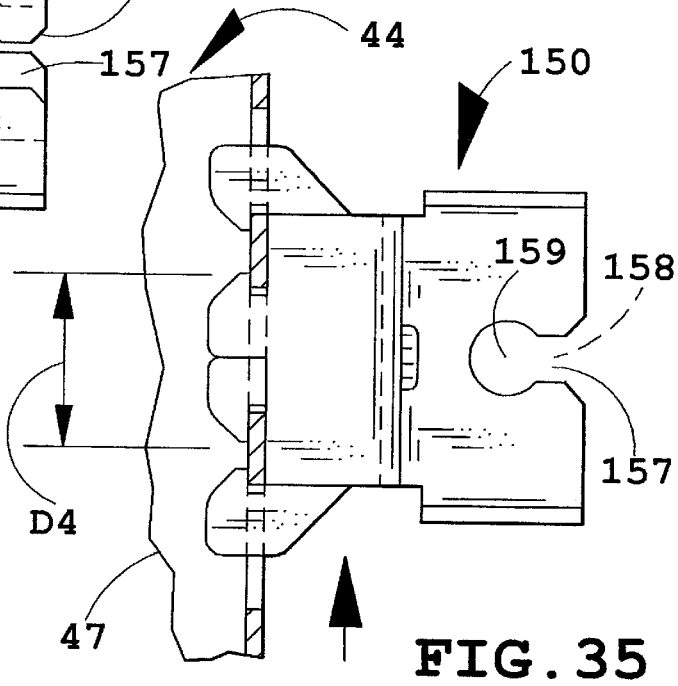

Off-module connector 150 (FIGS. 32–35) is constructed to connect a four-inch "zonewall" partition frame 44 to another such partition frame 44' (FIG. 33). Off-module connector 150 (FIG. 32) includes a pair of Z-shaped plates 152 and 153 slidably secured together by a rivet 154. One plate 152 includes a pair of hooks 155 oriented laterally/horizontally in a first direction, and the other plate 153 includes a second pair of hooks 156 oriented laterally/horizontally in a second direction opposite the first direction. The hooks 155 and 156 are configured to overlap to define a narrow dimension D3 when the plates 152 and 153 are shifted to one side to a release position (FIG. 34). In the release position, the hooks 155 and 156 are collapsed and can be inserted into the furniture-component-supporting slots in direction A, such as slots 84. When shifted in an opposite direction to an interlocked/engaged position (FIG. 35), the hooks 155 and 156 are spread apart to a dimension D4 and securely engage the material forming the furniture-component-supporting slots. Slots 157 and 158 are located at the end of plates 152 and 153 opposite the hooks 155 and 156. These slots 157 and 158 align when the plates 152 and 153 are slid to the interlocked/engaged position. The slots 157 and 158 include an enlarged end forming a pocket 159 for receiving and capturing/retaining a shaft of a screw 144. As previously described, the screw 144 engages an extruded hole in the partition frame 44. The Z shape of the connector 150 is configured to position the slotted end of plates 152 and 153 at a height adjacent the extruded hole on frame 44 that screw 144 engages (FIG. 33). Tabs 152A and 153A are provided on the edges of plates 152 and 153 to facilitate unlocking and locking the plates 152 and 153.

A second off-module connector 160 (FIGS. 36–37) is used for off-module interconnection of finwall partition frames 45. The details of off-module connector 160 are described in detail in U.S. application Ser. No. 08/686,913, which has been previously incorporated by reference. Briefly, the off-module connector 160 includes a pair of legs 161 resiliently connected together by a resiliently flexible looped end 162. The legs 161 have opposing hooks 163 at their free ends adapted to engage furniture-component-supporting slots in frames 44 or 45. The legs 161 are Z-shaped for locating the spring end 162 at a predetermined height relative to the slots in frames 44 or 45 so that end 162 is positioned adjacent an extruded hole and screw 144. A slot is defined between legs 161, including an enlarged region defining a pocket 164 for receiving the shaft of screw 144. When the shaft of screw 144 is located in pocket 164, the shaft is captured, and further the legs 161 are forced apart to securely non-releasably engage the slots to which they are attached. As with the four-inch partition frame 44, two of more of the off-module connectors 160 will typically be used to secure a finwall partition frame 45 to a main/spine partition frame, one at a top and one at a bottom of frame 45. A tab 164A extends from looped end 162 for engaging a detail on the frame 45 to maintain connector 160 in longitudinal alignment with the horizontal member to which it is attached.

Stacker connector 170 (FIGS. 29 and 38) is used to securely connect a stacker frame such as stacker frame 120 to a base partition frame 44. The stacker connector 170 is a tube having a square cross section. Two spaced apart attachment holes 171 and two spaced apart attachment slots 171' are formed in connector 170, two at each end. The two slots 171' at the bottom align with holes in the top of the upright 46 of base partition frame 44, and the holes 171 at the top align with holes in the bottom of the upright 121 of stacker partition frame 120. Bolts 172 are extended through the holes for clamping the stacker connector 170 to the respective uprights 46 and 121.

Figure 41:
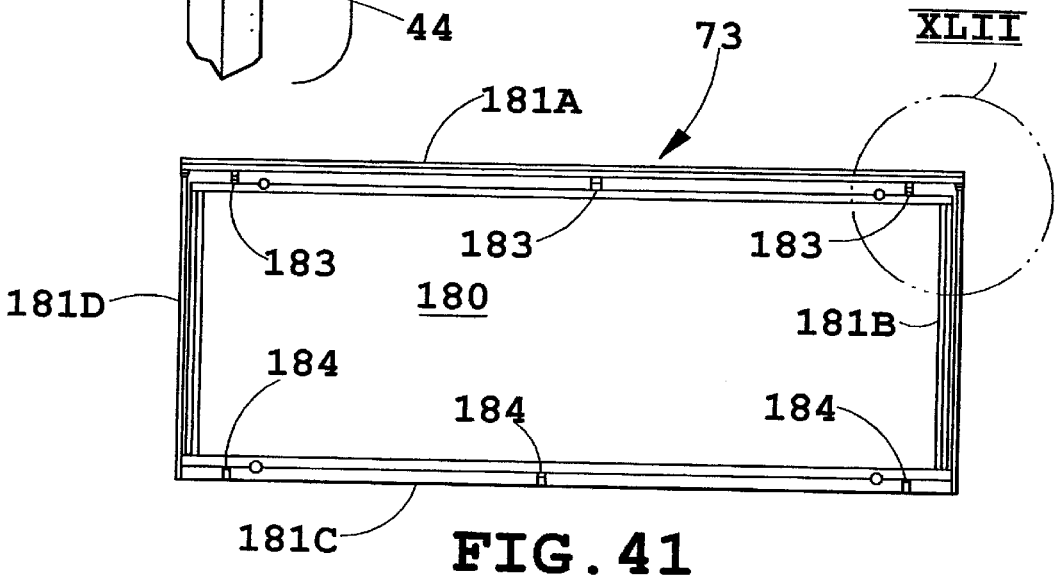
FIG. 41 is a rear plan view of an inside of the cover panel shown in FIGS. 1 and 6 for covering the partition frames of FIGS. 2, 15 and 22.

Cover panel 73 (FIG. 41) includes a large flat panel 180 made from any number of different materials, such as sheet metal, plastic, particulate materials, composite materials, and combinations thereof. The illustrated cover panel 73 includes roll-formed sheet metal edging 181A–181D to protect, form, and strengthen the marginal edges of flat panel 180. The edging 181A–181D is configured along its perimeter to receivingly engage and support cover-panel-supporting resilient top connectors or clips 183, and cover-panel-supporting resilient bottom connectors or clips 184. Three such top and bottom clips 183 and 184 are shown in FIG. 41, although more or less can be added as needed for functional reasons. Also, additional clips 184 can be added along the vertical side edges 181B and 181D of cover panel 73, such as where the cover panel extends a significant vertical distance and where it is desirable to hold the middle of the cover panel to the frame.

Flat panel 180 (FIG. 44) includes a rear flange 188 to which edgings 181A–181D are spot welded or otherwise secured. Top edging 181A is a roll-formed part having a panel-engaging vertical flange 189. A top edge flange 190 extends forwardly from a top of vertical flange 189, and a doubled back lip 191 covers top edge flange 189. A second vertical flange 192 extends upwardly from a bottom edge of panel-engaging flange 189. The lower portion 193 of second vertical flange 192 is sandwiched against and engages the first vertical flange 189 to stiffen it. An upper portion 194 of second vertical flange 192 extends upwardly but is offset therefrom to create a space 195. The cross section of edgings 181B–181D are identical to the cross section of edging 181A. It is noted that edgings 181B and 181D can be cut short at the ends to eliminate interference. Alternatively, the flanges 189 and 192 on adjacent corner pieces can be cut so that the flanges 189 and 192 overlap. For example, the flange 189 could be cut short and the flange 192 left long on edging 181A, and the flange 192 cut short and the flange 189 left long on edging 181B, so that flange 192 of edging 181A overlaps with flange 189 of edging 181B.

Figure 45:
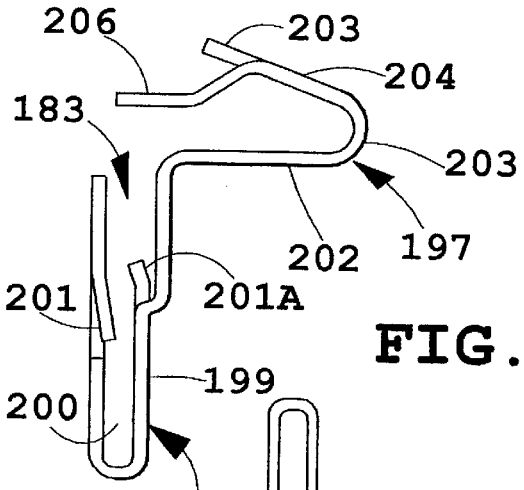
FIGS. 45 and 46 are side views of the upper and lower cover-panel-supporting connectors, respectively.

Cover-panel-supporting top connector or clip 183 (FIG. 45) includes a U-shaped cover-panel-engaging lower section 196 and a U-shaped frame-engaging upper section 197.

Lower section 196 includes opposing flanges 198 and 199 with a space 200 therebetween for frictionally engaging flanges 189 and 192 on edging 181A. Flange 199 is shaped to mateably engage flange 192 of edging 181A. A tooth 201 on flange 198 engages flange 189 and a second tooth 201A on flange 199 engages the bend 194' in flange 192 of edging 181A to prevent accidental disengagement or mislocation. The body panel rear flange 188 is notched to receive clip flange 198 such that it locates clip 183 on cover panel 73. Clip upper section 197 includes a flat horizontal bottom flange 202, a resilient end section 203, and a reversely bent angled flange 204. An interlocking antidislodgement tooth (or teeth) 205 extends from angled flange 204, tooth 205 being coplanar with angled flange 204. A release/disengagement tab 206 also extends from angled flange 204. The tab 206 extends at an angle below tooth 205. Tab 206 extends through a plane defined by vertical flange 194 (FIG. 47) to a location within space 200. Tooth 205 does not extend through the plane defined by vertical flange 194, such that clip 183 cam be inserted into a frame member 48 to engage tooth 205 with an inside surface 207 of the horizontal frame member.

Figure 48:
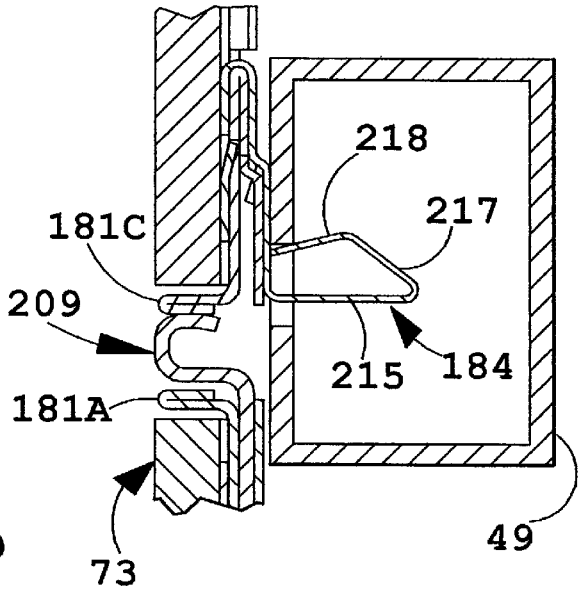
FIG. 48 is a side cross sectional view of the cover panel and frame shown in FIG. 47, but including a tool ready to be engaged with the interlocking top connector immediately before releasing the top connector.
Figure 49:
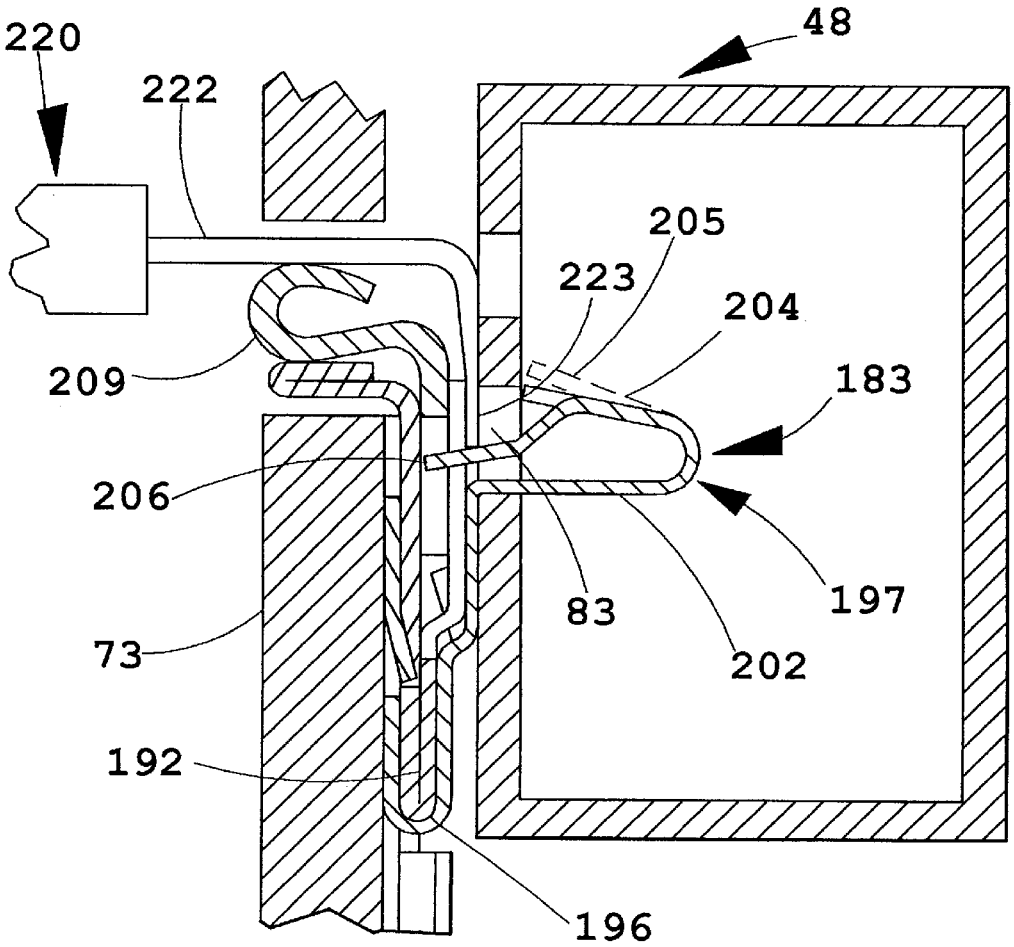
FIG. 49 is an enlarged view of the cover-panel-supporting top connector shown in FIG. 48, the top connector being held in its release position by the tool of FIG. 50.

A flexible trim strip or "worm" 209 (FIG. 47) includes an attachment leg 210 that fits into the space 200 in edgings 181A. Leg 210 can include a hook or enlargement (see strips 209A in FIG. 47A) or can include a J-shaped lower portion 209B' (see strips 209B in FIG. 47B) to provide secure retention, or can be glued in place if desired. A top section 211 of strip 209 is U-shaped and flexible with a durometer of about 88 per ASTM D2240-75 testing, so that it takes the space between vertically adjacent cover panels 73. The top section 211 expands to aesthetically fill the gap between cover panels 73 and to hide the furniture-component-supporting slots (such as slots 84). However, top section 211 is resiliently compressible to permit access behind the strip 209 and to the slots when desired (notice FIG. 48). Also, the top section 211 flexes around any brackets attached to the slots (84). Attachment leg 210 is stiffer than top section 211, with a durometer of about 80 per ASTM D2240-75 testing. Also, it is notched to receive tab 206 on clip 183, and to permit vertical operative movement of tab 206. It is contemplated that trim strip 209 can be co-extruded of two different durometer materials to achieve the flexibility of top section 211 and stiffness of leg 210 desired. By forcing tab 206 downwardly with a tool such as tool 220, the resilient end section 203 of clip 183 flexes downwardly, causing antidislodgement tooth 205 to move from a raised frame-engaged/interlocking position (FIG. 47) to a frame-released/disengaged position (FIG. 49).

Figure 7:
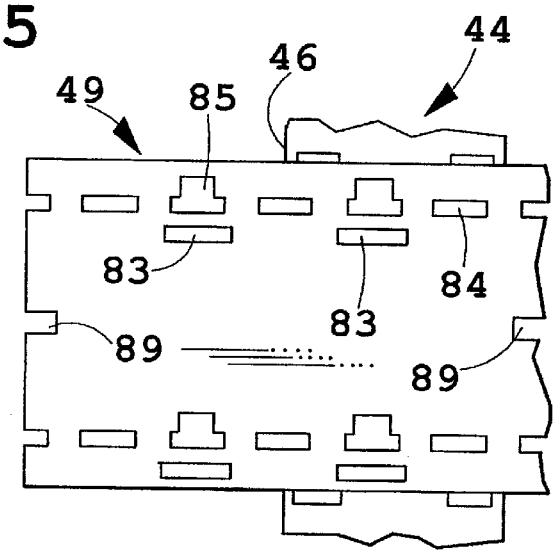
Figure 8:
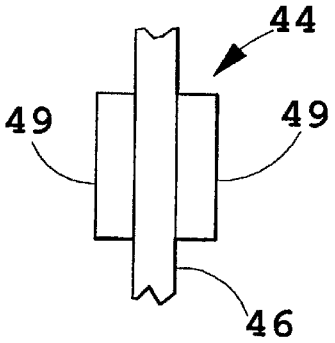
Figure 46:
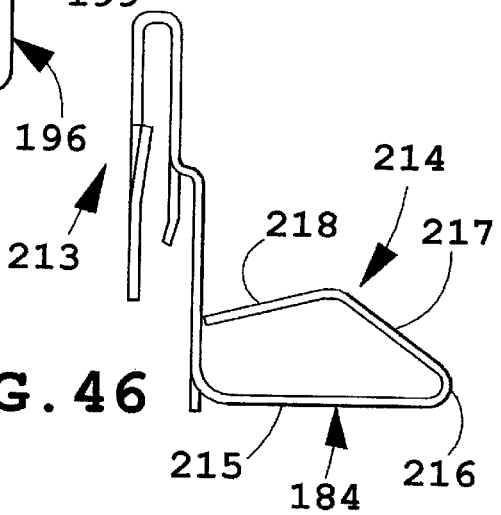

Cover-panel-supporting bottom connector or clip 184 (FIG. 46) includes a U-shaped cover-panel-engaging upper section 213 that is an inverted mirror image of lower section 196 on clip 183. A frame-engaging lower section 214 extends from a bottom of upper section 213. Lower section 214 includes a flat horizontal bottom flange 215, a resilient end section 216, and a reversely bent upwardly angled flange 217. A downwardly angled flange extension 218 extends from angled flange 217. The flange extension 218 frictionally engages and upper edge of an aperture or notch, such as notch 85, in a horizontal frame member, such as frame member 49 (FIG. 7). Alternatively, flange 218 is constructed to engage a lower edge of flange 103 on bottom horizontal frame member 51.

Figure 47:
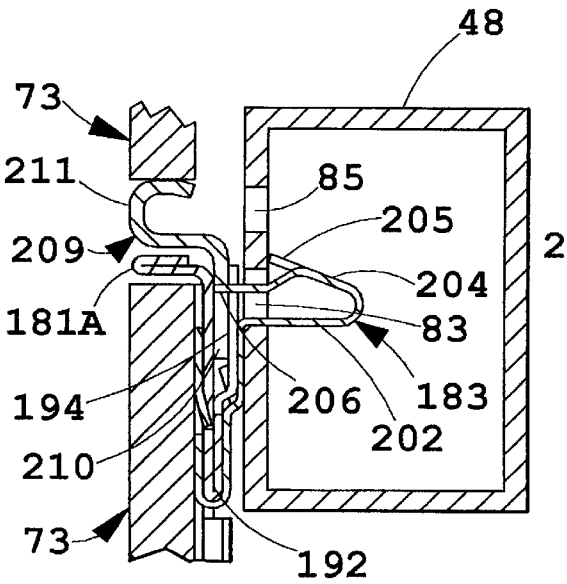
FIG. 47 is a side cross sectional view of the cover panel of FIG. 41 attached to a partition frame.
Figure 47:
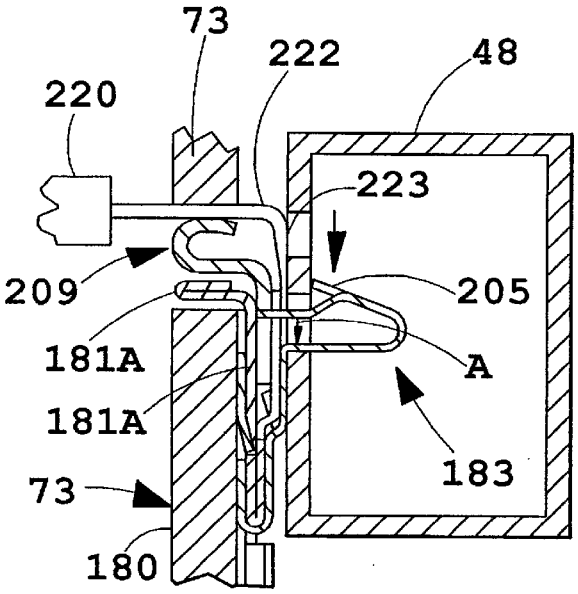
Figure 47:
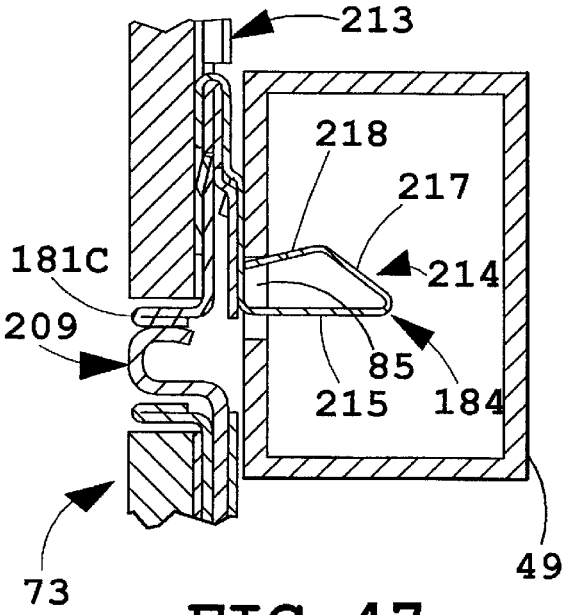
Figure 47A:
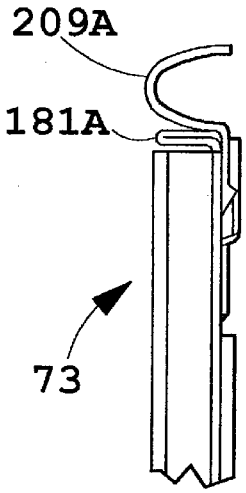
FIGS. 47A and 47B are side views of modified trim strips similar to the trim strip shown in FIG. 47.
Figure 47B:
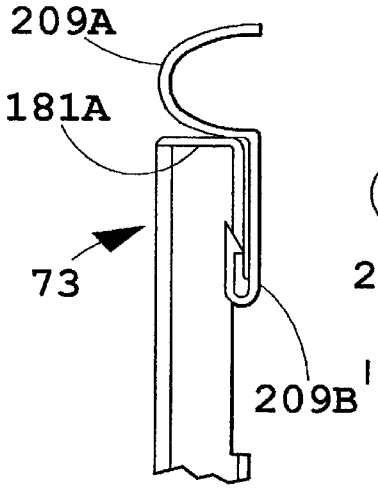

The cover panel 73 can be attached to a pair of vertically spaced horizontal frame members, such as the illustrated frame member 48 and 49 (FIG. 47), by engaging top clips 183 until the antidislodgement teeth 205 engage the upper frame member 48 (FIG. 47). Then the lower clips 184 are snapped into engagement with the lower frame member 49. Notably, frame members 48 and 49 are used for illustrative purposes, but the clips can be engaged with any pair of frame members 46–51 or similarly vertically spaced horizontal frame members.

When attached, opposing cover panels 73 define an internal cavity within the frame 44 that extends horizontally the width of the partition frame, and substantially the entire height of the frame. Wires can be laid in to the internal cavity, and can be routed around uprights between the uprights and an inner surface of the cover panels. Notably, the space between the outer surface of the uprights and the inner surface of the cover panels is about 1 inch, and substantially outboard of the upright outer surface, such that conduit-covered wires that are ¾" or more can be easily routed along and around the internal cavity. Since the uprights are about 1 inch thick, the internal cavity is about 3 inches total in thickness for a "four-inch" partition system 42 having a partition frame 44.

It is also contemplated that clips 183 and/or 184 can be used to attach a cover panel to vertical frame members as well. For example, cover panels incorporating the clips 183 and/or 184 could be attached to Steelcase Series 9000 partition panels, which panels are well-known in the industry. The antidislodgement clip 183 is particularly useful where secure attachment but releasable attachment of cover panels is desired, such as to resist failure from a catastrophic event (e.g., earthquakes).

Figure 50:
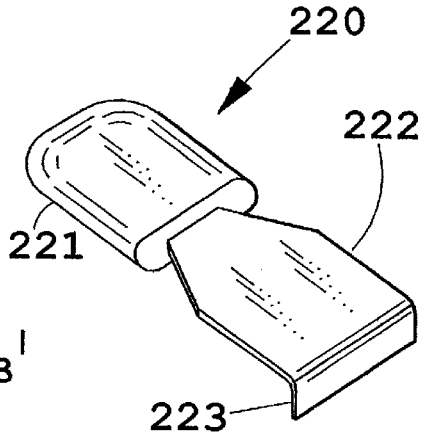
FIG. 50 is a perspective view of the tool of FIG. 49 for releasing the interlocking top connector on the cover panel.

In order to remover cover panel 73, it is necessary to release/disengage the antidislodgement tooth 205 of top clips 183. For this purpose, a tool 220 (FIG. 50) is provided. Tool 220 is basically a putty knife or thin-bladed tool having a handle 221 and a stiff, flat, sheet metal blade 222. An end 223 of the blade 222 is bent 90 degrees to form a flange. The required height of the end flange 223 depends on the dimensions of the cover panel 73 and the location of the top clips 183. It is contemplated that the height of end flange 223 will be about ½ inch to ¾ inch. The tip of end flange 223 can be angled/tapered inwardly from its edges to its center to create a ramp that facilitates its use, as described below.

Tool 220 (FIG. 48) can be manipulated over trim strip 209 into the gap between vertically adjacent cover panels 73 so that end flange 223 is positioned between a front face 225 of frame member 48 and the rear surface of rear flange upper portion 194 of cover panel top edging 181A. In this position, tool 220 can be slid horizontally until end flange 223 engages a disengagement tab 206. By rotating tool 220, the tip of end flange 223 can be positioned on disengagement tab 206. By thereafter oppositely rotating the tool 220, end flange 223 engages tab 206 and forces release tab 206 and antidislodgement tooth 205 downwardly. This disengages clip 183 from frame 48, so that clip retention upper section 197 can be pulled through the aperture 83 in frame member 48. Tool 220 can be conveniently slid horizontally along a top edge of cover panel 73 to repeatedly and quickly release clip after clip after clip. The bottom of cover panel 73 can be pulled outwardly to resiliently release bottom clips 184.

MODIFIED EMBODIMENT

Figure 51:
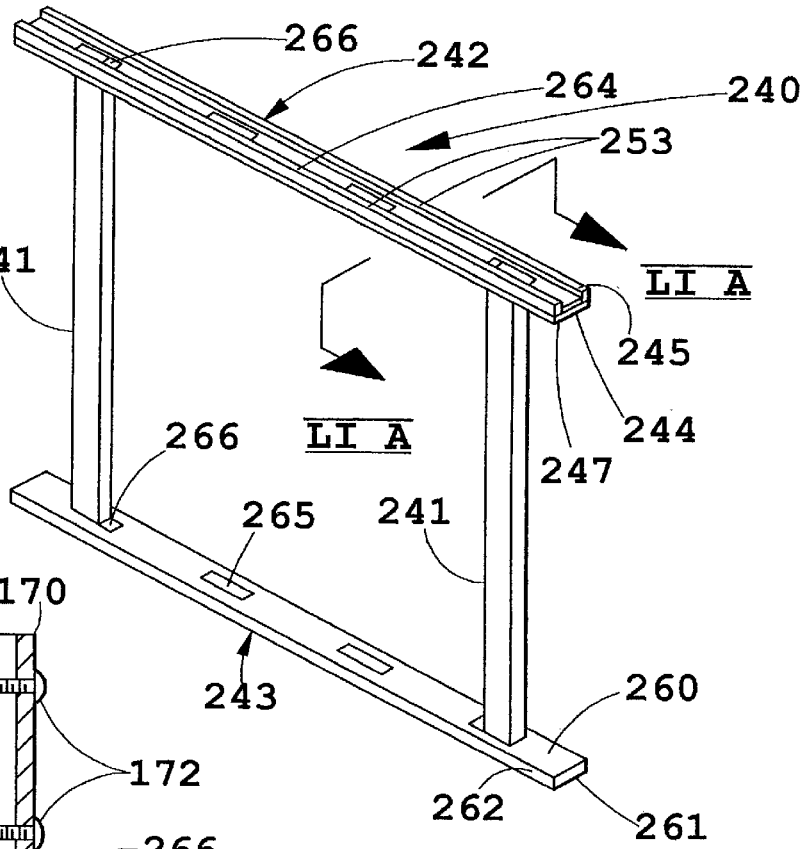
FIG. 51 is a perspective view of a second embodiment freestanding partition frame embodying the present invention
Figure 57:
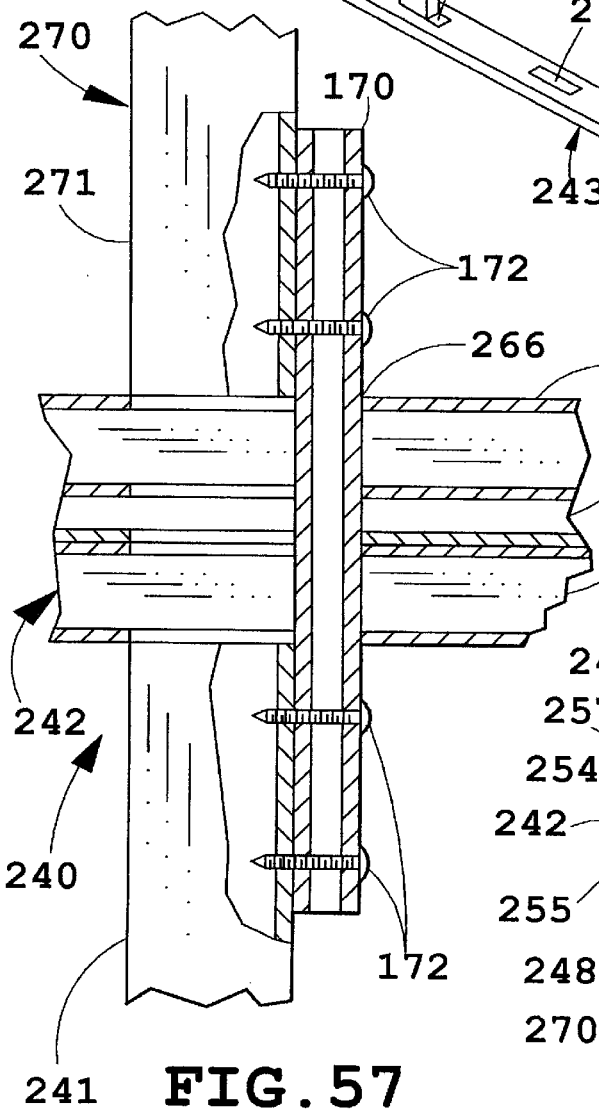
FIG. 57 is an enlarged view of the stacker connecting structure in FIG. 55.

The partition frame 240 (FIG. 51) is similar to the partition frame 44 in that partition frame 240 includes spaced apart tubular uprights, and a plurality of horizontal frame members attached to the uprights with opposing faces spaced outwardly of the sides of the uprights. Also, the top horizontal frame member includes a tubular portion, although in frame 240 the top horizontal frame member is two-piece. Further, the partition frame 240 is similar to frame 44 in that a top channel is formed in a top of the top horizontal frame member. Still further, both arrangements/constructions allow the horizontal side members to be vertically adjusted relative to the top and bottom horizontal frame members, even though a top end of the uprights are butt welded to a bottom of the top horizontal frame member, thus permitting the horizontal frame members (including the horizontal row of holes in their sides) to be accurately located relative to each other.

Figure 51A:
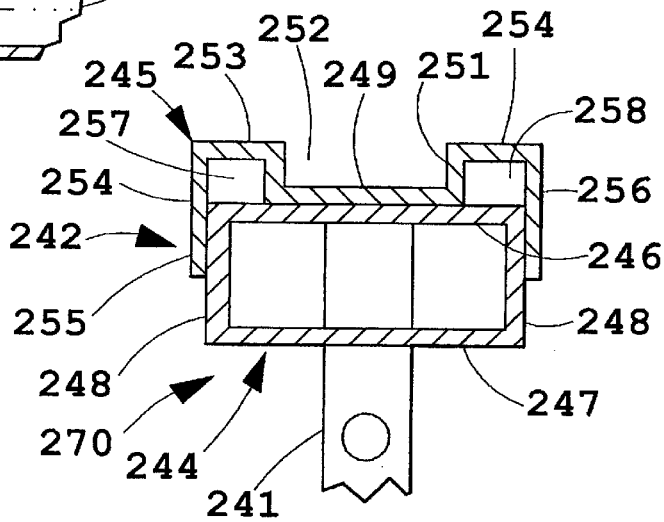
FIG. 51A is a cross sectional view taken along the line LIA—LIA in FIG. 51.
Figure 52:
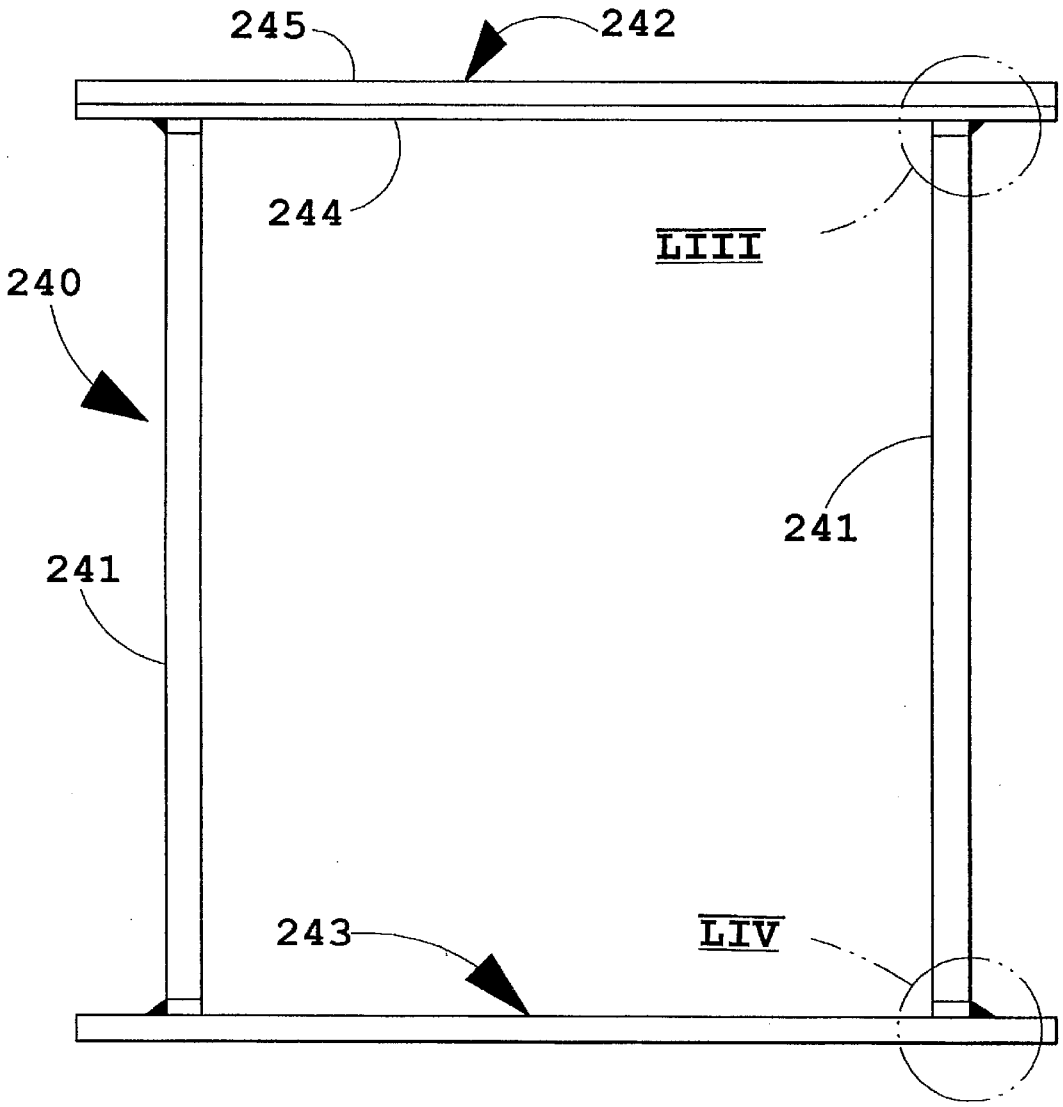
FIG. 52 is a side view of the partition frame of FIG. 51.
Figure 53:
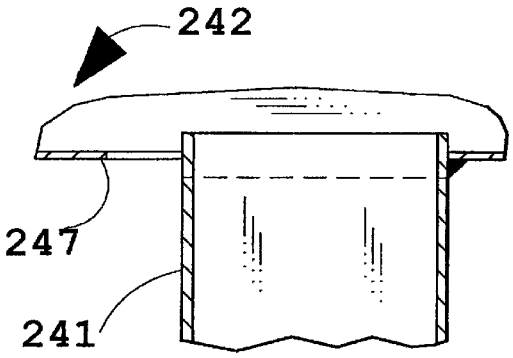
FIGS. 53–54 are enlarged views of the circled areas LIII—LIII and LIV—LIV in FIG. 52.
Figure 54:
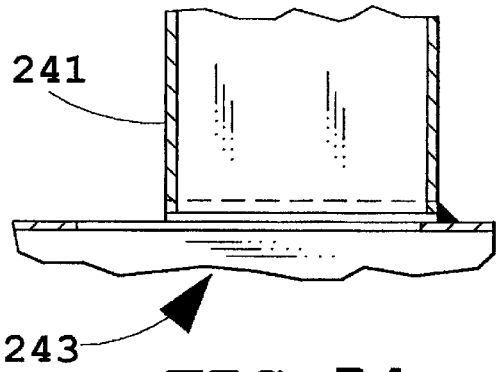
Figure 55:
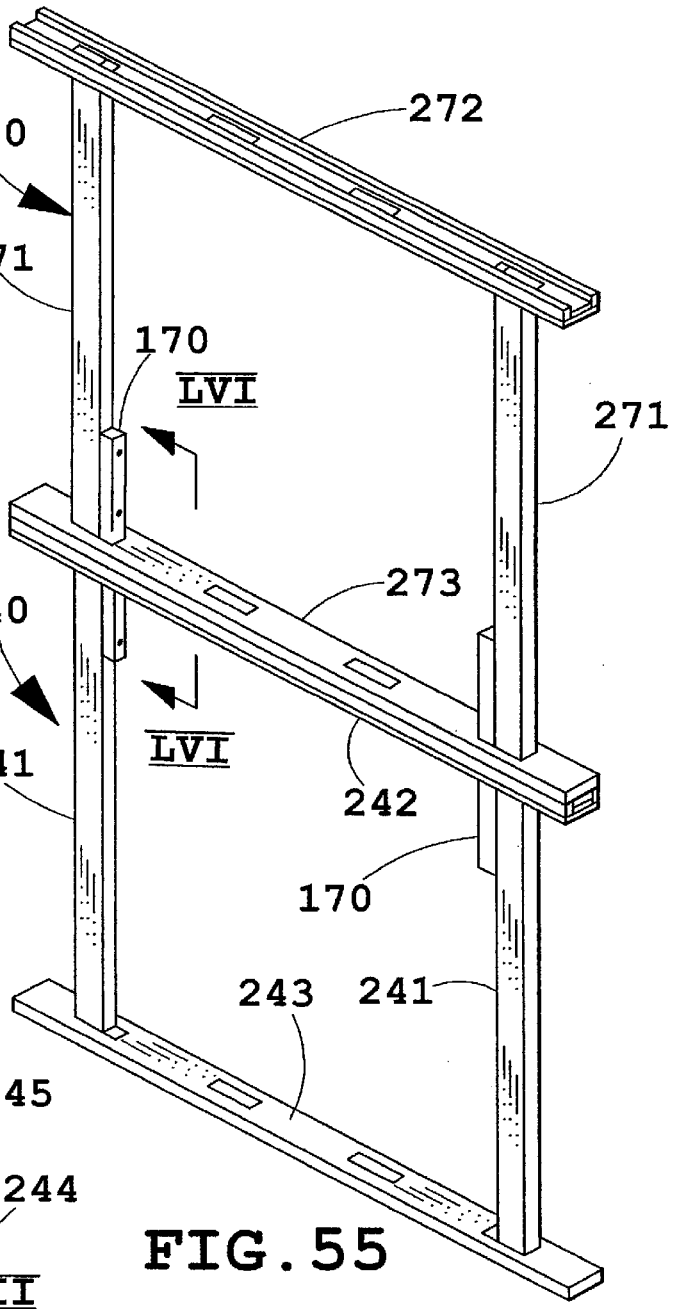
FIG. 55 is a perspective view of a stacked partition frame arrangement, including the base partition frame of FIG. 51 and including a stacker frame placed on the base frame.
Figure 56:
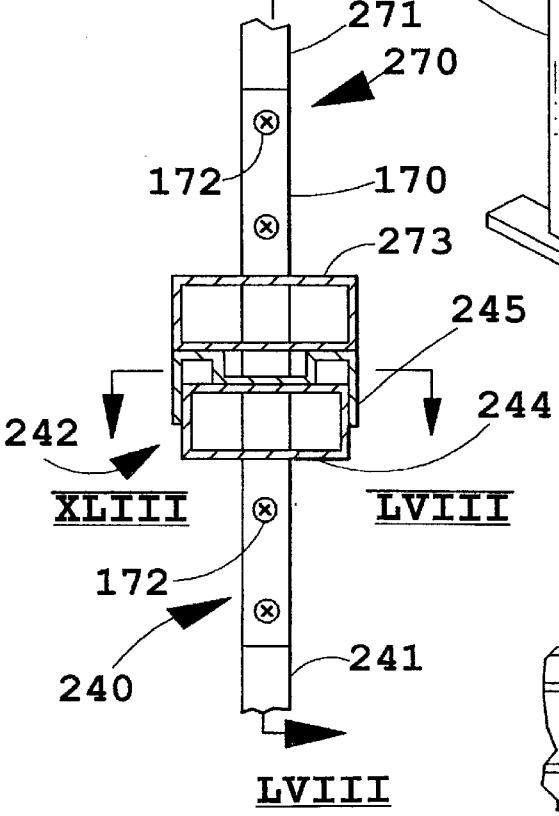
FIG. 56 is a cross sectional view taken along the line LVI—LVI in FIG. 55.
Figure 58:
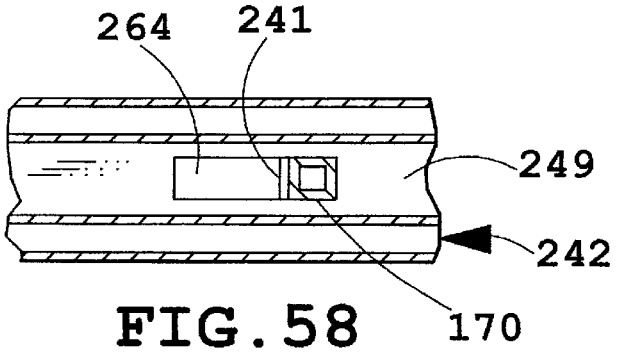
FIG. 58 is a cross sectional view taken along the line LVIII—LVIII in FIG. 56.

More specifically, the partition frame 240 (FIG. 51) includes a pair of rectangular tubular uprights 241, and top and bottom horizontal frame members 242 and 243, respectively, welded to the uprights 241. Intermediate horizontal frame members, such as members 48–50 (FIGS. 2–3) can be secured to uprights 241 at various heights as desired. Top horizontal frame member 242 (FIG. 51A) includes a tubular member 244 and an inverted "W" channel 245. Tubular member 244 includes a top flange 246, a bottom flange 247, and sidewalls 248 connecting flanges 246 and 247. Channel 245 includes a horizontal transverse flange 249 and opposing inner vertical flanges 250 and 251 forming an upwardly open channel space 252. Two flat upper flanges 253 and 254 extend horizontally outwardly from flanges 250 and 251, and a pair of outer sidewalls 255 and 256 extend downwardly from flanges 252 and 254. The outer sidewalls 255 and 256 include a lower edge that extends overlappingly onto sidewalls 248 of tubular member 244, to which they are welded. A space 257 is created behind channel sidewall 255 and above tube top flange 246, and another space 258 is created behind channel sidewall 256 and above the tub top flange 247. A pattern of cover-panel-supporting apertures and furniture-component-supporting apertures (not shown) identical to the apertures 72 and 74 (FIG. 5) are formed in the channel sidewalls 255 and 257 beside spaces 257 and 258, so that cover panel connectors and hooked brackets can be extended through the apertures into the spaces for permitting operative connection of cover panels 73 and furniture components (e.g. off module positioned partition panels, binder bins, shelves, and the like.).

The bottom horizontal frame member 243 (FIG. 51) is rectangular, and includes a top flange 260, a bottom flange 261, and sidewalls 262 connecting top and bottom flanges 260 and 261. The sidewalls 262 are spaced apart a distance equal to sidewalls 248 on W channel 245 of top horizontal frame member 242, so that their outer surfaces vertically align.

Notably, the illustrated uprights 241 (FIG. 51) are extended through an aperture in the bottom flange 247 of tubular member 244 and are butt welded to the top flange 246. Alternatively, the top end of the uprights 241 can be butt welded to the bottom flange 247 of the tubular member 244. A rectangular aperture is formed in the bottom flange 247 (and also in top flange 246 if desired) of tubular member 244 for receiving the top end of the uprights 241. This allows the upright 241 to be extended into the interior of the tubular top horizontal frame member 242. Advantageously, this allows the top horizontal frame member 242 to be vertically adjusted/fixtured relative to the bottom horizontal frame member 243 before the top horizontal frame member 242 is welded to the uprights 241. In particular, the location of the apertures in sidewalls 255 is very accurately controlled relative to the flat upper flanges 253, such that a top of the flat upper flanges 253 are used as reference surfaces during fixturing. The result of this welded assembly is a structurally strong top horizontal frame member 240 that is adapted to carry loads, such that it can support binder bins over predetermined relatively-long spanning distances, as discussed above in regard to frame 44. The concurrent result is a partition frame 240 having very accurately vertically spaced horizontal members with correspondingly accurately-located apertures therein for receiving cover-panel-supporting clips on cover panels, and additional accurately-located apertures for receiving hooked brackets for supporting furniture components. This particular process/method of constructing a partition frame, including fixturing off of a top flat surface, and vertically adjusting, fixturing, and welding horizontal frame members relative to the top flat surface and/or fixturing relative to side-facing apertures in a top frame member to accurately locate horizontal rows of apertures is believed to be novel, and further is believed to provide surprising and unexpected results in terms of its manufactureability and quality. Notably, the above-described fixturing method and assembly process is equally applicable to the frames 44, 45, 120 and 240.

Rectangular apertures 264 and 265 (FIG. 51) are formed in top and bottom horizontal frame members 242 and 243, respectively, for providing passageways for routing wires and utilities therethrough. The apertures 264 and 265 nearest the ends of the frame members 242 and 243 include inboard portions forming a square opening 266 when mated with the uprights 241, which square opening 266 is adapted to receive the square tubular stacking bracket or connector 170 (FIGS. 55–58). (Compare to FIGS. 29 and 30.)

The stacking frame 270 (FIG. 55) includes uprights 271 and top and bottom horizontal frame members 272 and 273 that are essentially identical to the corresponding components of base frame 240. Base frame 240 is different from stacking frame 270 in that base frame 240 includes leveler members (not shown, but see FIGS. 2 and 12). The leveler members are not shown in FIG. 55 on base frame 240 so that the square hole 266 is easily visible. However, the leveler members includes a hex-nut (like nut 58 in FIG. 12) located in the square opening 266, and a leveler screw (like threaded rod 59 in FIG. 12) that threadably engages the nut and that extends below the bottom horizontal frame member 243 for engaging a floor channel (see FIGS. 22–23 and 39–40).

To assembly stacking frame 270 to base frame 240, stacking frame 270 is rested on base frame 240. Thereafter, the stacking connector 170 is extended through the bottom horizontal frame member 243 on the base frame 240 and through the top horizontal frame member 272 on the stacking frame 270 at a location adjacent their uprights 241 and 271. Screws 172 are extended into the upright 241 and 271 to secure the stacking connector 170 and in turn the stacking frame 270 in place on base frame 240.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A partition panel comprising:

a partition frame having a planar face with clip-receiving apertures and bracket-receiving apertures, the planar face having a back surface;

a pair of cover panels configured to cover the partition frame, the cover panels including side edges that define a gap therebetween and provide access to the bracket-receiving apertures when the cover panels are attached to the partition frame;

clips releasably engaging the clip-receiving apertures and retaining the cover panels on the partition frame in a coplanar arrangement, the clips each including an antidislodgement tooth interlockingly engaging the back surface when the clips are engaged with the clip-receiving apertures, and further including a release tab that is depressible to move the tooth to a disengaged position wherein the clips are released from the clip-receiving apertures; and a flexible strip attached to one of the cover panels and covering the gap when the cover panels are attached to the partition frame in a coplanar and adjacent position thereon.

2. The partition panel defined in claim 1 wherein the flexible strip includes an attachment leg engaging one of the cover panels and a flexible section engaging the other of the cover panels.

3. The partition panel defined in claim 2 wherein the flexible section comprises a curved wall section.

4. The partition panel defined in claim 3 wherein the flexible strip comprises a dual durometer extrusion.

5. The partition panel defined in claim 4 wherein the cover panel includes a marginal frame, and wherein the attachment leg has an enlarged section frictionally engaging a recess in the marginal frame.

6. The partition panel defined in claim 1 wherein the flexible strip comprises a dual durometer extrusion.

7. The partition panel defined in claim 1 therein the cover panel includes a marginal frame, and wherein the flexible strip includes an attachment leg that frictionally engages the marginal frame of the cover panel.

8. The partition panel defined in claim 1 wherein the clips are positioned behind the cover panel to which the clips are attached in a location that is not directly accessible nor visible through the gap.

9. The partition panel defined in claim 1 wherein the release tab extends forwardly beyond a front surface of the face when the tooth engages the back surface.

10. A partition panel comprising:

a partition frame having a planar face with a horizontal row of bracket-receiving apertures a pair of cover panels attached to the partition frame, the cover panels including top and bottom edges that define a gap therebetween and provide access to the bracket-receiving apertures;

a flexible strip attached to one of the cover panels and covering the gap and the bracket-receiving apertures; and a bracket having a connector portion shaped to depress the flexible strip and to engage selected ones of the bracket-receiving apertures to support furniture components on the partition frame.

11. The partition panel defined in claim 10 wherein the flexible strip includes an attachment leg engaging one of the cover panels and a flexible section engaging the other of the cover panels.

12. The partition panel defined in claim 11 wherein the flexible section comprises a curved wall section.

13. The partition panel defined in claim 12 wherein the flexible strip comprises a dual durometer extrusion.

14. The partition panel defined in claim 13 wherein the cover panel includes a marginal frame, and wherein the attachment leg has an enlarged section frictionally engaging a recess in the marginal frame.

15. The partition panel defined in claim 10 wherein the flexible strip comprises a dual durometer extrusion.

16. The partition panel defined in claim 10 wherein the cover panel includes a marginal frame, and wherein the flexible strip includes an attachment leg that frictionally engages the marginal frame of the cover panel.

17. A partition panel comprising:

a partition frame having a planar face with clip-receiving apertures and bracket-receiving apertures, the planar face having a back surface;

a pair of cover panels configured to cover the partition frame, the cover panels including side edges that define a gap therebetween and provide access to the bracket-receiving apertures when the cover panels are attached to the partition frame; and clips releasably engaging the clip-receiving apertures and retaining the cover panels on the partition frame in a coplanar arrangement, the clips each including a tooth interlockingly engaging the back surface when the clips are engaged with the clip-receiving apertures, and further including a release tab that is depressible to move the tooth to a disengaged position wherein the clips are released from the clip-receiving apertures, the clips being located at a position spaced away from the gap and behind the cover panels so that the clips are not visible through the gap from a position in front of the cover panels.

18. The partition panel defined in claim 17 wherein the clips are positioned behind the cover panel to which the clips are attached in a location that is not directly accessible nor visible through the gap.

19. The partition panel defined in claim 17 wherein the release tab extends forwardly beyond a front surface of the face when the tooth engages the back surface.

20. A method comprising steps of:

providing a partition frame having a planar face with clip-receiving apertures and bracket-receiving apertures, the planar face having a back surface;

providing a pair of cover panels releasably attached to the partition frame and covering the partition frame, the cover panels including side edges that define a gap therebetween and provide access to bracket-receiving apertures when the cover panels are attached to the partition frame, the cover panels each including clips releasably engaging the clip-receiving apertures and retaining the cover panels on the partition frame in a coplanar arrangement, the clips each including a tooth interlockingly engaging the back surface when the clips are engaged with the clip-receiving apertures, and further including a release tab that is depressible to move the tooth to a disengaged position wherein the clips are released from the clip-receiving apertures, the clips being located at a position spaced away from the gap and behind the cover panels so that the clips are not visible through the gap from a position in front of the cover panels;

providing a tool constructed to extend through the gap and extend behind a selected cover panel to engage the release tab on a selected clip;

depressing the release tab of the selected clip to release the associated tooth from engagement with the back surface of the partition frame;

sliding the tool along the gap to a next one of the clips; and repeating the steps of depressing and sliding until the clips of the cover panel are disengaged from the partition frame.

* * * * *

US005802789B1

REEXAMINATION CERTIFICATE (4196th)

United States Patent [19] [11] B1 5,802,789

Goodman et al. [45] Certificate Issued Nov. 7, 2000

[54] PARTITION CONSTRUCTION INCLUDING REMOVABLE COVER PANELS

[75] Inventors: Steven F. Goodman; Kenneth D. Brickner, both of Wyoming; Melissa A. DuBuis, Jenison; Daniel Grabowski; Allen C. Hager, both of Grand Rapids; Robert E. Jeffers, Ada; Karl J. Mead, Grand Rapids; Scott M. Miller, Kentwood; Kurt A. Jonker, Grand Rapids, all of Mich.

[73] Assignee: Steelcase Inc., Grand Rapids, Mich.

Reexamination Request:
No. 90/005,490, Sep. 10, 1999

Reexamination Certificate for:

| | |
|---|---|
| Patent No.: | **5,802,789** |
| Issued: | **Sep. 8, 1998** |
| Appl. No.: | **08/767,817** |
| Filed: | **Dec. 17, 1996** |

[51] Int. Cl.[7] ..... E04B 2/74

[52] U.S. Cl. ..... 52/239; 52/36.1; 52/238.1; 160/357

[56] References Cited

U.S. PATENT DOCUMENTS

| | | |
|---|---|---|
| 3,514,883 | 6/1970 | Albright . |
| 4,619,486 | 10/1986 | Hannah et al. . |
| 4,883,330 | 11/1989 | Armstrong et al. . |

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

*Primary Examiner*—Michael Safavi

[57] ABSTRACT

A partition panel includes a partition frame with a planar face having clip-receiving apertures for supporting cover panels and bracket-receiving apertures for supporting furniture components. A pair of cover panels configured to cover the partition frame include side edges that define a gap therebetween for providing access to the bracket-receiving apertures when the cover panels are attached to the partition frame. Clips on the cover panels are constructed to releasably engage the clip-receiving apertures for retaining the cover panels on the partition frame in a coplanar arrangement. The clips each include an antidislodgement tooth for interlockingly engaging a back surface of the face when the clips are engaged with the clip receiving apertures, and further include a release tab that is depressible to move the tooth to a disengaged position for releasing the clip from the associated clip-receiving aperture. The clips are located at a position spaced away from the gap and behind the cover panels so that the clips are not visible through the gap from a position in front of the cover panels. A flexible strip is attached to one of the cover panels for covering the gap when the cover panels are attached to the partition frame in a coplanar and adjacent position thereon.

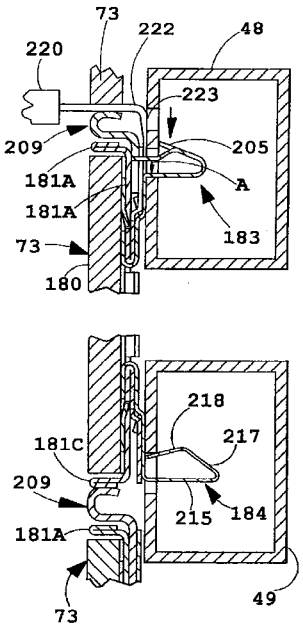

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *